US009093764B2

(12) United States Patent
Manahan et al.

(10) Patent No.: US 9,093,764 B2
(45) Date of Patent: Jul. 28, 2015

(54) ELECTRICAL CONNECTORS WITH FORCE INCREASE FEATURES

(71) Applicants: Joseph Michael Manahan, Manlius, NY (US); Adam Ledgerwood, Geneva, NY (US)

(72) Inventors: Joseph Michael Manahan, Manlius, NY (US); Adam Ledgerwood, Geneva, NY (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/744,058

(22) Filed: Jan. 17, 2013

(65) Prior Publication Data

US 2014/0199869 A1 Jul. 17, 2014

(51) Int. Cl.

| | |
|---|---|
| ***H01R 13/15*** | (2006.01) |
| ***H01R 13/11*** | (2006.01) |
| ***H01R 13/193*** | (2006.01) |
| *H01R 13/33* | (2006.01) |

(52) U.S. Cl.

CPC ..... *H01R 13/11* (2013.01); *H01R 13/193* (2013.01); *H01R 13/33* (2013.01)

(58) Field of Classification Search

CPC ..... H01R 13/193
USPC ..... 439/263, 346, 948, 848
See application file for complete search history.

(56) References Cited

U.S. PATENT DOCUMENTS

| | | | | |
|---|---|---|---|---|
| 203,931 | A * | 5/1878 | Nickerson | 279/42 |
| 377,237 | A * | 1/1888 | Cole | 439/507 |
| 1,657,253 | A * | 1/1928 | Fortin | 439/788 |
| 1,697,503 | A * | 1/1929 | Hollwitz | 439/263 |
| 1,719,288 | A * | 7/1929 | Danielson | 439/252 |
| 1,956,037 | A * | 4/1934 | MacDonald | 439/848 |
| 2,269,314 | A * | 1/1942 | MacDonald | 439/848 |
| 2,393,083 | A * | 1/1946 | Wizegarver | 439/268 |
| 2,456,764 | A | 12/1948 | Bach et al. | |
| 2,521,722 | A * | 9/1950 | Hubbell et al. | 439/788 |
| 2,567,727 | A | 9/1951 | Quackenbush | |

(Continued)

FOREIGN PATENT DOCUMENTS

| | | |
|---|---|---|
| EP | 0449737 | 10/1991 |
| JP | 1017382 | 1/1989 |

(Continued)

OTHER PUBLICATIONS

Surikov, S., International Search Report and Written Opinion of the International Searching Authority for PCT/US2014/011254, May 5, 2014, pp. 1-7.

*Primary Examiner* — Neil Abrams
(74) *Attorney, Agent, or Firm* — King & Spalding LLP

(57) ABSTRACT

An electrical connector having a reduced temperature rise system is described herein. The electrical connector can include a conductor receiver and a conductor mechanically coupled to the conductor receiver. The conductor can include a pin having electrically conductive material and an exposed end. The conductor can also include at least one compression member disposed along a portion of the outer perimeter of the pin at a first distance from the exposed end. When the conductor is coupled to the conductor receiver, the compression member contacts the wall of the conductor receiver to the pin. Alternatively, the conductor receiver can have an electrically conductive first portion and a second portion. Further, the conductor can have a conductive pin and a guide pin. The guide pin can force the first portion to expand and compress around the conductive pin as the conductor is mechanically coupled to the conductor receiver.

25 Claims, 11 Drawing Sheets

(56) References Cited

U.S. PATENT DOCUMENTS

| | | | | | |
|---|---|---|---|---|---|
| 2,794,964 | A | * | 6/1957 | Hoffman | 439/877 |
| 2,877,437 | A | * | 3/1959 | Flanagan, Jr. | 439/353 |
| 2,930,023 | A | * | 3/1960 | Earl | 439/732 |
| 2,997,681 | A | * | 8/1961 | Klassen | 439/268 |
| 3,094,365 | A | * | 6/1963 | Chamberlain et al. | 439/263 |
| 3,122,408 | A | * | 2/1964 | Laszczewski | 439/625 |
| 3,171,183 | A | * | 3/1965 | Johnston | 24/635 |
| 3,182,281 | A | * | 5/1965 | Salz, Sr. | 439/441 |
| 3,275,970 | A | * | 9/1966 | Johanson et al. | 439/578 |
| 3,325,775 | A | * | 6/1967 | Zak | 439/848 |
| 3,350,681 | A | * | 10/1967 | Benoit et al. | 439/837 |
| 3,394,341 | A | * | 7/1968 | Venn | 439/593 |
| 3,439,294 | A | | 4/1969 | Flanagan et al. | |
| 3,569,903 | A | * | 3/1971 | Brishka | 439/352 |
| 3,596,231 | A | | 7/1971 | Melton | |
| 3,605,074 | A | | 9/1971 | Freggens et al. | |
| 3,697,934 | A | | 10/1972 | Merry | |
| 3,792,418 | A | | 2/1974 | Kailus | |
| 3,798,586 | A | * | 3/1974 | Huska | 439/263 |
| 3,829,820 | A | * | 8/1974 | Hubner et al. | 439/848 |
| 3,912,353 | A | * | 10/1975 | Kasuya et al. | 439/329 |
| 3,976,352 | A | * | 8/1976 | Spinner | 439/140 |
| 4,195,902 | A | | 4/1980 | Caveney et al. | |
| 4,341,432 | A | | 7/1982 | Cutchaw | |
| 4,405,195 | A | * | 9/1983 | Cherry et al. | 439/825 |
| 4,432,038 | A | | 2/1984 | Bell | |
| 4,445,747 | A | * | 5/1984 | Neidich | 439/787 |
| 4,530,553 | A | * | 7/1985 | Aujla | 439/62 |
| 4,560,222 | A | * | 12/1985 | Dambach | 439/373 |
| 4,597,620 | A | * | 7/1986 | Lindner et al. | 439/277 |
| 4,655,526 | A | * | 4/1987 | Shaffer | 439/268 |
| 4,684,193 | A | * | 8/1987 | Havel | 439/259 |
| 4,780,799 | A | | 10/1988 | Groh | |
| 4,781,611 | A | * | 11/1988 | Leonard | 439/259 |
| 4,887,353 | A | | 12/1989 | Preputnick | |
| 4,906,212 | A | * | 3/1990 | Mixon, Jr. | 439/857 |
| 5,007,858 | A | | 4/1991 | Daly et al. | |
| 5,217,392 | A | | 6/1993 | Hosler, Sr. | |
| 5,224,918 | A | | 7/1993 | Neumann et al. | |
| 5,263,874 | A | | 11/1993 | Miller | |
| 5,309,983 | A | | 5/1994 | Bailey | |
| 5,391,089 | A | * | 2/1995 | Quickel et al. | 439/260 |
| 5,397,858 | A | | 3/1995 | Delalle | |
| 5,433,622 | A | | 7/1995 | Galambos | |
| 5,482,480 | A | * | 1/1996 | Miyazaki | 439/774 |
| 5,514,001 | A | * | 5/1996 | Szegda | 439/263 |
| 5,551,884 | A | * | 9/1996 | Burkhart, Sr. | 439/140 |
| 5,601,443 | A | * | 2/1997 | Stinsky et al. | 439/263 |
| 5,735,716 | A | * | 4/1998 | Bilezikjian | 439/843 |
| 5,898,569 | A | | 4/1999 | Bhatia | |
| 5,947,753 | A | | 9/1999 | Chapman et al. | |
| 6,002,585 | A | | 12/1999 | Leeb | |
| 6,039,614 | A | * | 3/2000 | Ramari | 439/843 |
| 6,062,919 | A | | 5/2000 | Trafton | |
| 6,257,911 | B1 | * | 7/2001 | Shelby et al. | 439/268 |
| 6,575,776 | B1 | | 6/2003 | Conner et al. | |
| 6,602,091 | B2 | | 8/2003 | Belady et al. | |
| 6,612,857 | B2 | | 9/2003 | Tolmie | |
| 6,712,621 | B2 | | 3/2004 | Li et al. | |
| 6,714,809 | B2 | * | 3/2004 | Lee et al. | 600/423 |
| 6,736,668 | B1 | | 5/2004 | Kholodenko et al. | |
| 6,860,743 | B2 | * | 3/2005 | Ekkul et al. | 439/76.1 |
| 6,953,348 | B2 | | 10/2005 | Yanagisawa et al. | |
| 7,128,604 | B2 | | 10/2006 | Hall | |
| 7,134,906 | B2 | | 11/2006 | Lawton et al. | |
| 7,217,154 | B2 | | 5/2007 | Harwath | |
| 7,264,485 | B2 | | 9/2007 | Larsen et al. | |
| 7,291,030 | B2 | | 11/2007 | Mohs | |
| 7,357,657 | B2 | * | 4/2008 | Wells | 439/263 |
| 7,422,471 | B1 | | 9/2008 | Wu | |
| 7,442,081 | B2 | | 10/2008 | Burke et al. | |
| 7,473,142 | B2 | * | 1/2009 | Chien et al. | 439/669 |
| 7,476,108 | B2 | | 1/2009 | Swain et al. | |
| 7,541,135 | B2 | | 6/2009 | Swain | |
| 7,597,573 | B2 | | 10/2009 | Defibaugh et al. | |
| 7,641,506 | B2 | | 1/2010 | Sacher et al. | |
| 7,690,941 | B2 | | 4/2010 | Caveney et al. | |
| 7,699,634 | B2 | | 4/2010 | Kholodenko et al. | |
| 7,726,982 | B2 | | 6/2010 | Ngo | |
| 7,828,572 | B1 | * | 11/2010 | Liu | 439/270 |
| 7,833,023 | B2 | | 11/2010 | Di Stefano | |
| 7,854,063 | B2 | | 12/2010 | Harwath | |
| 8,083,539 | B2 | * | 12/2011 | Suzuki et al. | 439/427 |
| 8,382,509 | B2 | | 2/2013 | David et al. | |
| 8,585,438 | B2 | * | 11/2013 | Tang | 439/578 |
| 8,587,946 | B2 | | 11/2013 | Lee et al. | |
| 8,613,626 | B1 | * | 12/2013 | Phan | 439/181 |
| 8,845,350 | B2 | * | 9/2014 | Connell | 439/268 |
| 2004/0181177 | A1 | * | 9/2004 | Lee et al. | 600/585 |
| 2007/0259537 | A1 | | 11/2007 | Kohlstrung | |
| 2012/0052720 | A1 | | 3/2012 | David et al. | |
| 2012/0058670 | A1 | | 3/2012 | Regnier et al. | |
| 2012/0115363 | A1 | | 5/2012 | Myong | |
| 2012/0258624 | A1 | | 10/2012 | Oh | |
| 2014/0071680 | A1 | * | 3/2014 | Hayashi et al. | 362/249.07 |
| 2014/0199881 | A1 | | 7/2014 | Manahan et al. | |

FOREIGN PATENT DOCUMENTS

| | | |
|---|---|---|
| JP | 2005056770 | 3/2005 |
| SU | 1576949 | 7/1990 |
| WO | 9311584 | 6/1993 |
| WO | 9517027 | 6/1995 |
| WO | 2008050184 | 5/2008 |

* cited by examiner

ELECTRICAL CONNECTORS WITH FORCE INCREASE FEATURES

RELATED APPLICATIONS

The present application is related to a patent application titled "Active Cooling of Electrical Connectors," filed Jan. 17, 2013, assigned U.S. patent application Ser. No. 13/744,125, and that has issued as U.S. Pat. No. 8,926,360.

TECHNICAL FIELD

The present disclosure relates generally to electrical connectors and more particularly to systems, methods, and devices for reducing the temperature rise of an electrical connector.

BACKGROUND

Electrical connectors are used in a number of different electrical applications. For example, electrical connectors are used in households, commercial facilities, and industrial sites. Electrical connectors can be used for a number of different applications, including but not limited to lighting, electronics, appliances, motors, fans, and control centers. Each electrical connector is rated for a certain voltage and/or current. As the current and/or voltage rating of a connector increases, the size of the conductors increase. Correspondingly, the size (e.g., length, width) of the pins (also called conductors and/or are electrically and mechanically coupled to conductors) and receivers (also called pin receivers or conductor receivers) of the mating connector components also increases.

When a conductor is not properly connected to a conductor receiver, one or more of a number of electrically-related problems can arise. For example, when voltage is applied to a conductor that is not properly connected to a conductor receiver, overheating (even to the extent of a fire) can result. Historical testing suggests that the increase in temperature can be 20° C. to 35° C., assuming that the conductor and conductor receiver of the electrical connector are properly designed and manufactured. Electrical connectors that are not properly designed and manufactured, or that have undergone a certain amount of mechanical wear, can result in increases in temperature that can exceed 35° C. Also, to compensate for the temperature rise, conductors and a corresponding electrical connector can be sized larger than actually needed so that the proper amount of voltage and/or current, net of losses from an inadequate connection between the conductor and conductor receiver, is delivered. Often times, the operating temperature (driven in some cases by temperature rise caused by an electrical connector) dictates the minimum applicable cable rating used for an application.

In addition, if the components of the electrical connector are mechanically coupled and decoupled on a relatively frequent basis, the parts (e.g., conductor, conductor receiver) may wear more quickly causing inadequate connection between the conductor and the conductor receiver. Such wear can also occur if the electrical connector is subject to vibrations or other types of movement. Wear of an electrical connector results in a loss of surface contact between the components of the electrical connector. The loss of surface contact results in a temperature rise. In severe cases, inadequate surface contact results in arcing and/or welding.

SUMMARY

In general, in one aspect, the disclosure relates to an electrical connector. The electrical connector includes a conductor receiver and a conductor. The conductor receiver can have an electrically conductive material, a receiving end, and at least one wall enclosing a cavity and forming a receiver shape, where the conductor receiver has an inner perimeter. The conductor can be mechanically coupled to the conductor receiver through the receiving end. The conductor receiver can include a pin that includes the electrically conductive material and an exposed end, where the pin has an outer perimeter. The conductor receiver can also include at least one compression member disposed along a portion of the outer perimeter of the pin at a first distance from the exposed end, where the at least one compression member extends away from the outer perimeter and toward the exposed end at an acute angle. The at least one wall can contact the pin when the conductor receiver is mechanically coupled to the conductor.

In another aspect, the disclosure relates to an electrical connector. The electrical connector includes a conductor receiver and a conductor. The conductor receiver has a first ring portion and a base portion. The first ring portion has an electrically conductive material, and at least one first wall enclosing a first cavity, forming a first receiver shape, and having a first inner perimeter. The first ring portion can also have at least one slot that extends along a length of the first portion. The base portion can include at least one second wall enclosing a second cavity, forming a second shape, and having a second inner perimeter. The conductor can be mechanically coupled to the conductor receiver through the first cavity of the first portion and the second cavity of the second portion. The conductor can include a conductive pin having the electrically conductive material and a distal mating end, where the conductive pin mechanically couples to the first portion of the conductor receiver. The conductor can also include a guide pin mechanically coupled to the conductive pin and the second portion of the conductor receiver, wherein the guide pin includes an electrically non-conductive material.

In yet another aspect, the disclosure relates to a method for increasing a contact surface within an electrical connector. The method can include inserting an exposed end of a pin into a conductor receiver. The method can also include applying, as the exposed end of the pin is being inserted into the conductor receiver, an inward force on at least one portion of a wall of the conductor receiver, where the inward force is applied using at least one compression member disposed along a portion of an outer perimeter of the pin at a first distance from the exposed end, where the at least one compression member extends away from the outer perimeter and toward the exposed end at an acute angle. The method can further include contacting, using the inward force, the at least one portion of the wall against the outer perimeter of the pin.

In still another aspect, the disclosure relates to a method for increasing a contact surface within an electrical connector. The method can include inserting a distal portion of a guide pin into a ring portion of a conductor receiver, where the guide pin is mechanically coupled to a conductive pin, where the guide pin is electrically non-conductive, where the conductive pin and the ring portion of the conductor receiver are electrically conductive, where the conductive pin has a larger perimeter than the front portion of the guide pin and the ring portion of the conductor receiver, and where the ring portion of the conductor receiver is expandable. The method can also include applying a lateral force to the guide pin, where the lateral force moves the guide pin further into the ring portion of the conductor receiver. The method can further include expanding, using a proximal end of the guide pin, a cross-sectional area of the ring portion of the conductor receiver. The method can also include applying the lateral force to the guide pin, where the lateral force moves the guide pin beyond the ring portion of the conductor receiver into a base portion of the conductor receiver, and where the lateral force moves the conductive pin into the ring portion of the conductor receiver. The ring portion of the conductor receiver can compress upon an outer surface of the conductive pin.

In yet another aspect, the disclosure relates to an electrical connector. The electrical connector includes a conductor receiver and a conductor. The conductor receiver can include a number of contact segments arranged circumferentially around, and mechanically coupled to, a first end piece at a proximal end and a second end piece at a distal end, where the contact segments form a cavity, where each of the contact segments is made of a semi-flexible and resilient electrically conductive material and has a profile, and where each of the contact segments has a middle portion that is directed inward relative to the proximal end and the distal end. The conductor can be mechanically coupled to the conductor receiver through the cavity. The conductor can include a distal end having a first perimeter, and a proximal end having the electrically conductive material and having a second perimeter and a shape, where the second perimeter is greater than the first perimeter. The conductor can also include a ramp disposed between the distal end and the proximal end. The shape can correspond to the profile of the plurality of contact segments. The middle portion of each of the contact segments can contact the proximal end of the conductor when the conductor is inserted into the conductor receiver.

In still another respect, the disclosure relates to an electrical connector. The electrical connector includes a conductor receiver and a conductor. The conductor receiver can include a body having a cavity that runs longitudinally therethrough and, at a proximal end, at least one compression member that extends away from the cavity at an acute angle and forms a space. The conductor receiver can also include an element movably disposed within the cavity that traverses the length of the body and having a proximal end that extends into the space created by the at least one compression member, where the element is made of an electrically conductive material. The conductor receiver can also include a webbed clip fixedly coupled to the proximal end of the electrically conductive element. The webbed clip can include a base mechanically coupled to the proximal end of the electrically conductive element and having the electrically conductive material. The webbed clip can also include at least one clip arm mechanically coupled to the base, and have at least one hinged feature and the electrically conductive material. The webbed clip can further include at least one clip finger mechanically coupled to a distal end of the at least one clip arm and be made of the electrically conductive material. The webbed clip can also include a compressive element disposed around the electrically conductive element in the space between the base and the body. The conductor can be mechanically coupled to the webbed clip. The conductor can include an extension disposed at a distal end of the conductor and having a size sufficient to contact the base and avoid contacting the at least one clip arm. The conductor can also include a pin mechanically coupled to the extension and be made of the electrically conductive material. The at least one clip finger can contact the pin when the conductor is inserted into the conductor receiver.

In yet another aspect, the disclosure relates to an electrical connector. The electrical connector includes a conductor receiver system and a conductor. The conductor receiver system can include a frame, a conductor receiver, and a displacement device. The conductor receiver can be coupled to the frame and can include a proximal collar fixedly coupled to the frame and having a shape. The conductor receiver can also include a distal collar having an electrically conductive material and having substantially the shape. The conductor receiver can further include a meshing mechanically coupled to the proximal collar and the distal collar, where the meshing is made of the electrically conductive material and has a first perimeter in an unstretched state and a second perimeter in a stretched state. The displacement device of the conductor receiver can be fixedly coupled to the distal collar and movably coupled to the frame, where the displacement device moves in a lateral direction relative to the proximal collar. The conductor can be mechanically coupled to the conductor receiver through the proximal collar, where the conductor includes a pin made of the electrically conductive material and has a third perimeter. The third perimeter of the pin can be less than the first perimeter of the meshing. The third perimeter of the pin can be greater than the second perimeter of the meshing.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION

Figure 1:
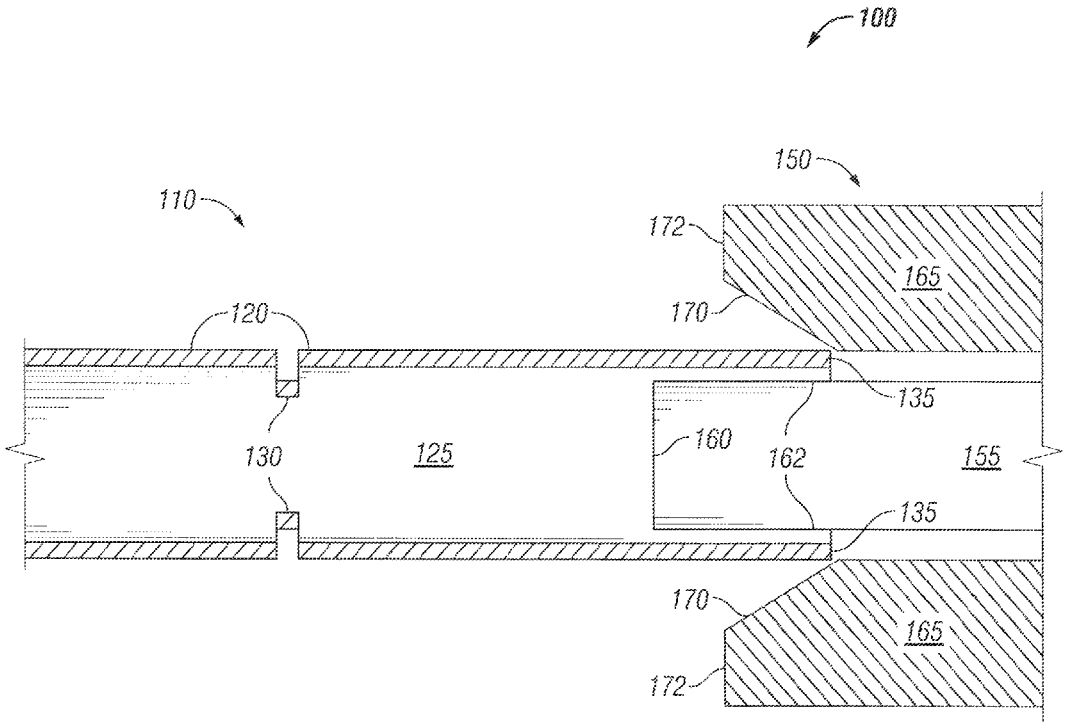
FIG. 1 shows an example electrical connector in accordance with certain example embodiments.

Example embodiments of reduced temperature rise of electrical connectors will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. Further, certain descriptions (e.g., top, bottom, side, end, interior, inside, inner, outer) are merely intended to help clarify aspects of the invention and are not meant to limit embodiments described herein.

In general, example embodiments provide systems, methods, and devices for reduced temperature rise of electrical connectors. Specifically, example embodiments provide for reduced temperature rise of an electrical connector by improving electrical contact between a conductor and a conductor receiver within the electrical connector. One scientific theory that addresses this reduction in temperature rise can be shown by the following equation:

$$Ac = \pi f \frac{\rho}{2Rc},$$

where Ac is me real conducting area, ρ is the resistivity value, Rc is the contact resistance, and f is the number of contact segments.

The preceding equation dictates that as the contact area is increased, the contact resistance decreases. Similarly, as the number of contact segments increases, the contact resistance also decreases. When this knowledge is combined with the equation $Q=I^2R$ (where Q is the heat produced, I is the electrical current, and R is the total resistance), a conclusion to be drawn is that heat decreases as resistance decreases. So, by improving electrical contact between a conductor and a conductor receiver, the temperature rise at the connection point (s) is lowered. In other words, because the contact between the conductor and conductor receiver is improved, the loss of energy (which results in heat) is reduced. As a result, the conductor and conductor receiver experience less wear and last longer using example embodiments described herein.

An electrical connector may involve a single conductor mated with a single conductor receiver. Alternatively, an electrical connector can also involve multiple conductors and/or multiple conductor receivers. An electrical connector may be used in a stand-alone application (e.g., feeding a junction box) or in integrated with an electrical device (e.g., a control center, a motor).

Example electrical connectors discussed herein can be used with one or more of a number of voltages and/or currents. For example, an electrical connector having an example reduced temperature rise system can be used for a 115 VAC wall outlet in a residential structure. As another example, an electrical connector having an example reduced temperature rise system can be used for a 400 A service to a large motor.

A user may be any person that interacts with an electrical connector having an example reduced temperature rise system. Examples of a user may include, but are not limited to, an engineer, an electrician, an instrumentation and controls technician, a mechanic, an operator, a consultant, a contractor, and a manufacturer's representative.

In certain example embodiments, an electrical connector having an example reduced temperature rise system (and/or an electrical device with which an electrical connector having an example reduced temperature rise system is integrated) is subject to meeting certain standards and/or requirements. For example, the National Electric Code (NEC) and the Institute of Electrical and Electronics Engineers (IEEE) set standards as to wiring and electrical connections. As another example, the National Electrical Manufacturer's Association (NEMA) classifies electrical connectors by current ratings (e.g., 15 A, 60 A), voltage ratings (e.g., 125V, 600V), conductor dimensions (e.g., widths, shapes, orientation), grounding requirements, and other factors. Use of example embodiments described herein meet (and/or allow a corresponding device to meet) such standards when required.

For each of the example embodiments described herein, the electrical connector includes a conductor and a conductor receiver. When the conductor and the conductor receiver are mechanically coupled to each other, power (current) can flow between the conductor and the conductor receiver. The wall of the conductor receiver, on an end opposite where the conductor receiver receives the conductor, can be mechanically coupled (directly or indirectly, such as with a cable) to one or more of a number of electrical devices, including but not limited to a motor, a control center, and a transformer. In such a case, the wall of the conductor receiver can be used to transfer power between the electrical device and the conductor. Examples of an electrical connector in which example embodiments can be used can be found in a patent application entitled "Active Cooling of Electrical Connectors" and filed concurrently herewith and referenced above. The entire contents of the patent application entitled "Active Cooling of Electrical Connectors" is fully incorporated herein by reference.

A conductor and a corresponding conductor receiver are mechanically coupled to each other to create an electrical connection. One or more of a number of other types of coupling may be used with example embodiments. Examples of other types of coupling can include, but are not limited to, slidably, movably, threadably, rotatably, hingedly, and slotably.

FIG. 1 depicts a cross-sectional side view of a portion of an electrical connector 100 using certain example embodiments described herein. In one or more embodiments, one or more of the components shown in FIG. 1 may be omitted, repeated, and/or substituted. Accordingly, embodiments of electrical connectors having an example reduced temperature rise system should not be considered limited to the specific arrangements of components shown in FIG. 1.

Referring now to FIG. 1, an example of a portion of the electrical connector 100 includes a conductor 150 and a conductor receiver 110. The portion of the electrical connector 100 shown in FIG. 1 can have a single conductor/conductor receiver pair, or the conductor 150 and conductor receiver 110 can be one of a number of conductor/conductor receiver pairs.

The conductor receiver 110 shown in FIG. 1 includes a wall 120 that encloses a cavity 125. The wall 120 forms a receiver shape (e.g., circle, ellipse, square, triangle, hexagon, star) when viewed in cross section. The receiver shape on the inner surface (inside) of the wall 120 has an inner perimeter. Likewise, the outer surface (outside) of the wall 120 can have an outer perimeter. The wall 120 of the conductor receiver 110 has a length, a width, and a thickness. The thickness of the wall 120 can vary or be substantially consistent along the length of the wall 120. Likewise, the width (e.g., the diameter of a circle, the length of the side of a square) can vary or be substantially consistent along the length of the wall 120.

In certain example embodiments, the conductor receiver 110 includes one or more optional protrusions 130 in the wall 120. Each protrusion 130 can extend from the wall 120 in toward the cavity 125. The distance that a protrusion 130 extends into the cavity 125 can vary, from completely across the cavity (i.e., touching the inner surface of the wall 120 on the opposite side of the conductor receiver 110) to a de minimis amount. A protrusion 130 can extend substantially normal to (perpendicular to) the wall 120. Alternatively, the protrusion 130 can extend from the wall 130 at a non-normal angle. The protrusion 130 can be one or more of a number of shapes, including linear, curved, stepped, convex, and concave. A protrusion 130 can have substantially uniform or varying thickness along its length. Each protrusion 130 is positioned at some distance from the receiving end 135 (i.e., the end of the conductor receiver 110 where the conductor 150 is received, also called the open end).

The end of the wall 120 opposite from the receiving end 135 can be mechanically coupled to one or more of a number of electrical devices, including but not limited to a motor, a control center, and a transformer. In such a case, the wall 120 can be used to transfer power between the electrical device and the pin 155 of the conductor 150.

The wall 120 and/or the one or more protrusions 130 of the conductor receiver 110 can be made of one or more of a number of suitable materials, including metal (e.g., alloy, stainless steel), plastic, some other material, or any combination thereof. In certain example embodiments, at least the portion of the wall 120 between the receiving end 135 and the one or more protrusions 130 is made of an electrically conductive material that allows current and/or voltage to be transferred between the conductor 150 and the conductor receiver 110. The wall 120 and the protrusion 130 can be made of the same or different materials. In certain example embodiments, the wall 120 and/or the receiving end 135 are made of a material and/or have a thickness that allows for the receiving end 135 to move inward (be compressed) when an inward force is applied to the receiving end 135. The wall and/or the receiving end 135 can be made of a compressible material (e.g., memory metal, a malleable metal).

The conductor 150 of the electrical connector 100 shown in FIG. 1 includes a pin 155 and at least one compression member 165. In certain example embodiments, the pin 155 is made of an electrically conductive material (e.g., copper, aluminum), which may be the same or a different electrically conductive material as the portion of the wall 120 of the conductor receiver 110 between the protrusion 130 and the receiving end 135. The pin 155 slidably couples to at least a portion of the wall 120 of the conductor receiver 110. In certain example embodiments, the pin 155 slidably couples to the portion of the wall 120 that is made of electrically conductive material. For example, if there is a protrusion 130, then the pin 155 is slidably coupled to the portion of the wall 120 between the protrusion 130 and the receiving end 135. In other words, as can be seen in FIG. 1, the protrusion 130 can be used both to provide additional electrical contact with the pin 155 and to act as a stop so that the pin 155 cannot be disposed further into the cavity 125 of the conductor receiver 110.

The pin 155 can be a solid piece, include a number of strands that are bundled together, and/or be part of some other arrangement. In certain example embodiments, the pin 155 is positioned within a cavity formed by the at least one compression member 165. The pin 155 has an outer perimeter and forms a shape when viewed in cross section. The shape of the pin (pin shape) can be the same or a different shape as the receiver shape.

For example, the pin shape and the receiver shape can be a circle, where the outer perimeter of the pin 155 is slightly less than the inner perimeter of the wall 120. As another example, the pin shape can be an isosceles triangle, where the receiver shape is a six-pointed star formed by an isosceles triangle overlapped with an inverted isosceles triangle. In such a case, the outer perimeter of the pin 155 is slightly less than the circumference of one of the isosceles triangles of the six-pointed star forming the receiver shape. When the conductor 150 is slidably and mechanically coupled to the conductor receiver 110, portions of the pin 155 contact portions of the wall 120. Where the pin 155 contacts the wall 120, electricity (e.g., current, voltage) is transferred between the wall 120 and the pin 155.

To assist in having more portions of the wall 120 contact the pin 155, the example compression member 165 can be used. For example, as shown in FIG. 1, the compression member 165 can be a continuous piece that surrounds the pin 155. The compression member 165 can also be a number of discrete pieces (e.g., wedges that run axially along the pin 155) that abut one another and/or have a gap therebetween. In certain example embodiments, each compression member 165 is disposed along at least a portion of the outer perimeter of the pin 155.

The compression member 165 can have one or more of a number of shapes. For example, outer surface of the compression member 165 can have the same shape as the portion of the outer surface (outer perimeter) of the pin 155 on which the compression member 165 is disposed. The outer surface of the compression member 165 can also have other shapes and/or features, including but not limited to notches, bumps, a rough texture, slots, and grooves. The inner surface (inner perimeter) of the compression member 165 can be substantially similar to the shape of the portion of the outer surface (outer perimeter) of the pin 155 on which the compression member 165 is disposed.

The compression member 165 can be disposed on the pin 155 in one or more of a number of ways. For example, the compression member 165 can be made of flexible and/or malleable material that is slid over the pin 155. As another example, the compression member 165 can be in molten form, poured into a mold surrounding at least a portion of the pin 155, and cooled to cure over the pin 155. The compression member 165 can be coupled to the pin 155 in one or more of a number of ways, including but not limited to fixedly, slidably, and removably.

In certain example embodiments, the compression member 165 is not disposed over the entire length of the pin 155, leaving a portion of the pin 155 exposed. When the portion of the pin 155 that is not covered by the compression member 165 is at the end of the pin 155 that slidably couples to the conductor receiver 110, such a portion can be called an exposed end 160 of the pin 155. The length of the exposed end 160 can vary or be substantially the same around the outer perimeter of the pin 155.

The profile of the end of the compression member 165 proximate to the exposed end 160 can vary. In certain example embodiments, as shown in FIG. 1, the end of the compression member 165 can have a wedge shape, formed by an angled portion 170, that can apply an inward force as a component (e.g., the wall 120 of the conductor receiver 110) is brought into contact with the angled portion 170. In other words, as the conductor 150 is slid into the conductor receiver 110, the angled portion 170 of the compression member 165 contacts the receiving end 135 of the wall 120, applying an inward force to the receiving end 135. The resulting inward force causes the receiving end 135 and adjacent portions of the wall 120 to compress and contact the pin 155.

The angled portion 170 of the compression member 165 can extend away from the outer perimeter (surface) of the pin 155 and toward the exposed end 160 of the pin 155 at an acute angle. In certain example embodiments, as shown in FIG. 1, the angled portion 170 is truncated, after extending some distance toward the exposed end 160, by a substantially horizontal end surface 172. In example embodiments where the conductor receiver 110 includes a protrusion 130, the distance between the protrusion 130 and the receiving end 135 of the wall 120 can be at least as great as the length of the exposed end 160.

The compression member 165 can be made of one or more of a number of materials. Examples of such materials include, but are not limited to, rubber, nylon, plastic, and metal. In certain example embodiments, the compression member 165 is not electrically conductive. However, electrically conductive material (e.g., copper, aluminum, steel) can be used in the compression member 165. For example, a sheet or layer of conductive material may be positioned inside of the compression member 165 along some or all of the length of the compression member 165 to provide a ground shield. As another example, a sheet or layer of conductive material may be positioned inside of the compression member 165 above the angled portion 170 to add stiffness to the angled portion 170 so that the angled portion 170 applies a stronger inward force to the receiving end 135 of the wall 120.

The end of the pin 155 opposite from the exposed end 160 can be mechanically coupled to one or more of a number of electrical devices, including but not limited to a motor, a control center, and a transformer. In such a case, the pin 155 can be used to transfer power between the electrical device and the wall 120 of the conductor receiver 110.

Figure 2A:
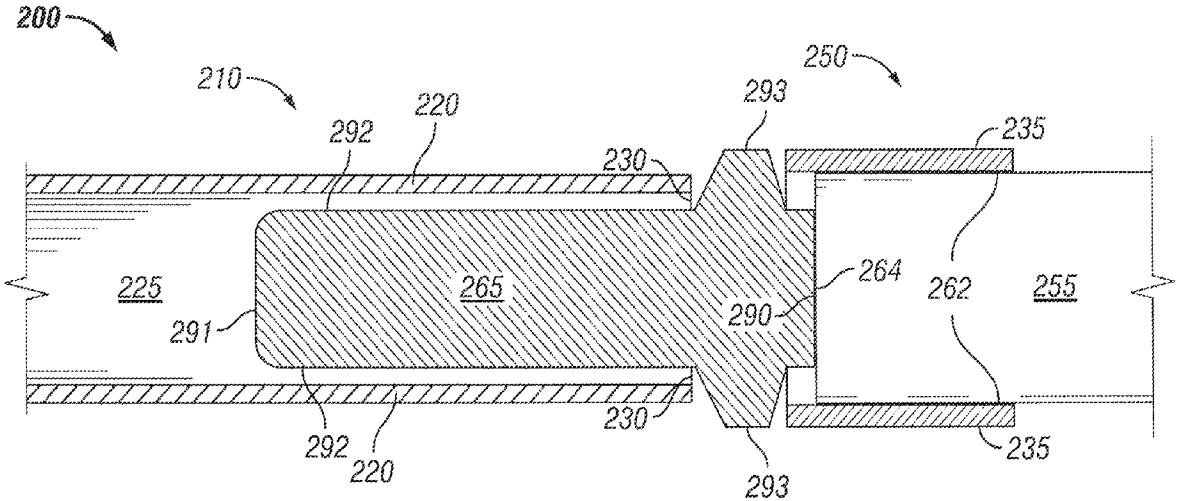
FIGS. 2A-2C show various views of an alternative example electrical connector in accordance with certain example embodiments.
Figure 2B:
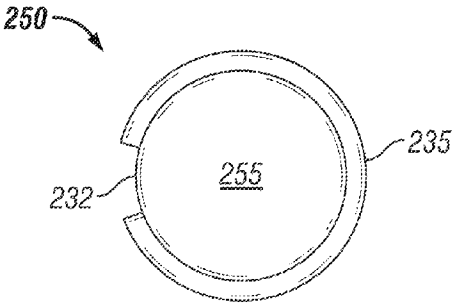
Figure 2C:
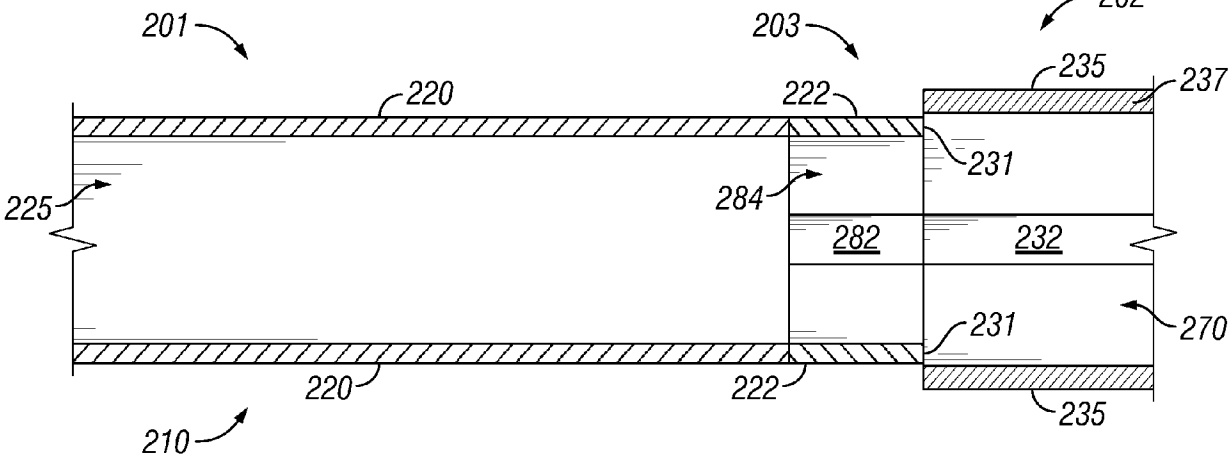

FIGS. 2A-2C show various views of an alternative example electrical connector 200 in accordance with certain example embodiments. Specifically, FIG. 2A shows a cross-sectional side view of the electrical connector 200. FIG. 2B shows a cross-sectional end view of a portion of the conductor 250 of the electrical connector 200. FIG. 2C shows a cross-sectional side view conductor receiver 210 of the electrical connector 200. In one or more embodiments, one or more of the components shown in FIGS. 2A-2C may be omitted, repeated, and/or substituted. Accordingly, embodiments of electrical connectors having an example reduced temperature rise system should not be considered limited to the specific arrangements of components shown in FIGS. 2A-2C.

Referring now to FIGS. 2A-2C, an example of a portion of the electrical connector 200 includes a conductor 250 and a conductor receiver 210. The portion of the electrical connector 200 shown in FIGS. 2A-2C can have a single conductor/conductor receiver pair, or the conductor 250 and conductor receiver 210 can be one of a number of conductor/conductor receiver pairs.

The conductor receiver 210 shown in FIG. 2C includes a first portion 201 and a second portion 202. The first portion 201 (also called a base portion), shown on the left side of FIG. 2C, includes a wall 220 that encloses a cavity 225. The wall 220 forms a receiver shape (e.g., circle, ellipse, square, triangle, hexagon, star) when viewed in cross section. The receiver shape on the inner surface (inside) of the wall 220 has an inner perimeter. Likewise, the outer surface (outside) of the wall 220 of the base portion 201 can have an outer perimeter. In certain example embodiments, the base portion 201 does not have a slot or similar feature running along its length. In other words, the inner perimeter of the base portion 201 may not expand when an inward force is applied to the base portion 201.

The second portion 202 (also called a ring portion or a wall portion) of the conductor receiver 210, shown on the right side of FIG. 2C, includes a wall 235 that encloses a cavity 270. The wall 235 forms a receiver shape (e.g., circle, ellipse, square, triangle, hexagon, star) when viewed in cross section. The receiver shape on the inner surface (inside) of the wall 235 has an inner perimeter. Likewise, the outer surface (outside) of the wall 235 of the first portion 202 can have an outer perimeter. The wall 235 of the second portion 202 can include a slot 232 that traverses some or all of the length of the second portion 202. The slot 232 allows the inner perimeter of the wall 235 of the ring portion 202 to expand or contract, depending upon whether an outward force is applied to (e.g., whether the guide pin 265 is being inserted into) the ring portion 202. The slot 232 can also allow one or more portions of the guide pin 265 (described below) to pass therethrough.

In certain example embodiments, one or more other features may be added to the conductor receiver 210 to replace or complement the slot 232. For example, instead of a slot 232, one end of the wall 237 of the ring portion 202 can overlap the other end of the wall 237. In such a case, the wall 237 could still expand when the guide pin 265 traverses therethrough. As another example, instead of a slot, one or more portions of the wall 237 of the ring portion 202 can include a retractable member that allows the wall 237 to expand when the guide pin 265 traverses therethrough.

Optionally, the conductor receiver 210 can include a third portion 203 (also called a gap portion 203) that is positioned between the base portion 201 and the ring portion 202. In certain example embodiments, the gap portion 203 is part of the base portion 201. The gap portion 203 can include a wall 222 that encloses a cavity 284 and one or more channels 282. The wall 222 forms a receiver shape (e.g., circle, ellipse, square, triangle, hexagon, star) when viewed in cross section. The receiver shape on the inner surface (inside) of the wall 222 has an inner perimeter. Likewise, the outer surface (outside) of the wall 222 of the gap portion 203 can have an outer perimeter. Each channel 282 of the gap portion 203 can traverse some or all of the length of the gap portion 203. The channel 282 allows one or more portions of the guide pin 265 (described below) to pass therethrough and/or to not pass therethrough. In certain example embodiments, the channel 282 of the gap portion 203 has the same width and/or aligns with the slot 232 of the ring portion 202.

The base portion 201, the ring portion 202, and/or the gap portion 203 can have the same or a different receiver shape. Further, the base portion 201, the ring portion 202, and/or the gap portion 203 can have the same or a different inner perimeter. For example, as shown in FIG. 2C, the inner perimeter of the base portion 201 is less than the inner perimeter of the ring portion 202, while the inner perimeter of the base portion 201 and the gap portion 203 are substantially the same.

The walls 220, 222, 235 of the conductor receiver 210 each have a length, a width, and a thickness. The thickness of the walls 220, 222, 235 can vary or be substantially consistent along the length of such wall. Likewise, the width (e.g., the diameter of a circle, the length of the side of a square) can vary or be substantially consistent along the length of the wall 220, 222, 235.

When the receiver shape and/or the inner perimeter of the base portion 201, the ring portion 202, and/or the gap portion 203 differ, one or more optional protrusions 231 may extend inward from the corresponding wall 220, 222, 235. In the example shown in FIG. 2C, the protrusion 231 (also called a shelf or ridge) is located where the ring portion 202 and the gap portion 203 are coupled.

Any protrusion 231 can serve one or more purposes similar to the purposes served by the protrusion 130 of FIG. 1 above. Specifically, a protrusion 231 can serve to provide additional electrical contact with the conductor 255 and/or to act as a stop so that the conductor 255 cannot be disposed further into the cavity 225 of the conductor receiver 210. Each protrusion 231 can extend from a wall in toward a corresponding cavity 225, 270, 284. The distance that a protrusion 231 extends into a cavity can vary, from completely across the cavity (i.e., touching the inner surface of the wall on the opposite side of the portion of the conductor receiver 210) to a de minimis amount.

A protrusion 231 can extend substantially normal to (perpendicular to) a wall. Alternatively, the protrusion 231 can extend from a wall at a non-normal angle. The protrusion 231 can be one or more of a number of shapes, including linear, curved, stepped, convex, and concave. A protrusion 231 can have substantially uniform or varying thickness along its length. Each protrusion 231 is positioned at some distance from the receiving end 237 (i.e., the end of the second portion 202 of the conductor receiver 210 where the conductor 250 is received, also called the open end).

A wall 220, 222, 235 and/or the one or more protrusions 231 of the conductor receiver 210 can be made of one or more of a number of suitable materials, including metal (e.g., alloy, stainless steel), plastic, some other material, or any combination thereof. In certain example embodiments, at least the portion of a wall between the receiving end 237 and the one or more protrusions 231 (e.g., the wall 235 of the second portion 202) is made of an electrically conductive material that allows current and/or voltage to be transferred between the conductor 250 and the conductor receiver 210. A wall and a corresponding protrusion 231 can be made of the same or different materials.

In certain example embodiments, a wall and/or the receiving end 237 are made of a material and/or have a thickness that allows for the receiving end 237 to expand outward when an outward force is applied to the receiving end 237. For example, as shown in FIG. 2B, the wall 235 of the second portion 202 expands, widening the slot 232, to allow the conductive pin 255 (described below) of the conductor 250 to slidably couple to the wall 235 of the second portion 202. The wall and/or the receiving end 237 can be made of a compressible material (e.g., memory metal, a malleable metal).

The conductor 250 of the electrical connector 200 shown in FIG. 2A includes a conductive pin 255 and a guide pin 265. In certain example embodiments, the conductive pin 255 is made of an electrically conductive material (e.g., copper, aluminum), which may be the same or a different electrically conductive material as the one or more walls of the conductor receiver 210 between the protrusion 231 and the receiving end 237. The conductive pin 255 slidably couples to at least a portion of the wall 235 of the ring portion 202 of the conductor receiver 210. In certain example embodiments, the conductive pin 255 slidably couples to the one or more walls of the conductor receiver 210 that are made of electrically conductive material. For example, if there is a protrusion 231 where the ring portion 202 and the gap portion 203 are joined, then the conductive pin 255 is slidably coupled to the wall 235 of the ring portion 202.

The conductive pin 255 can be a solid piece, include a number of strands that are bundled together, and/or be part of some other arrangement. In certain example embodiments, the conductive pin 255 is positioned within and/or surrounded by an insulated coating (not shown). The conductive pin 255 has an outer perimeter and forms a shape when viewed in cross section. The shape of the conductive pin 255 (conductive pin shape) can be the same or a different shape as a receiver shape (e.g., the receiver shape of the ring portion 202).

For example, the conductive pin shape and a corresponding receiver shape can be a square, where the outer perimeter of the conductive pin 255 is slightly greater than the inner perimeter of the wall 237. In such a case, when the conductive pin 255 is inserted into (slidably coupled with) the wall 237, the inner perimeter of the wall 237 expands to the point of being slightly greater than the outer perimeter of the conductive pin 255. When the wall 237 expands (widens the width of the slot 232), the wall 237 makes more solid contact with the conductive pin 255. When the conductor 250 is slidably and mechanically coupled to the conductor receiver 210, portions of the conductive pin 255 contact portions of one or more walls (e.g., wall 237). Where the conductive pin 255 contacts a wall, electricity (e.g., current, voltage) is transferred between the wall and the conductive pin 255.

To assist in sliding the larger conductive pin 255 through the smaller cavity 270 of the ring portion 202, the example guide pin 265 can be used. As shown in FIG. 2A, the proximal end 290 of the guide pin 265 can be mechanically coupled to the distal end 264 of the conductive pin 255. The guide pin 265 can be a single piece or a number of discrete pieces (e.g., wedges that run axially along the guide pin 265) that abut one another and/or have a gap therebetween. The guide pin 265 can be mechanically coupled to the conductive pin 255 using one or more of a number of methods, including but not limited to epoxy, compression fitting, mating threads, welding, and soldering.

In certain example embodiments, the guide pin 265 (which may or may not include the protruding feature 293) is made of electrically non-conductive material. Such material can have one or more of a number of characteristics, including but not limited to rigidity, slight compressibility, longevity, wear resistance, a low sliding friction, and a high melting point. The guide pin 265 has an outer perimeter and forms a shape when viewed in cross section. The shape of the guide pin 265 (guide pin shape) can be the same or a different shape as a receiver shape (e.g., the receiver shape of the base portion 201 and/or the ring portion 202). In addition, or in the alternative, the guide pin shape can be the same or different than the conductor pin shape of the conductive pin 255.

The guide pin 265 is made of an electrically non-conductive material and is used to properly align the conductive pin 255 within the cavity 270 of the second portion 202 of the conductor receiver 210. The guide pin 265 can also, in certain example embodiments, provide a wedge to begin expanding the cavity 270 (increasing the inner perimeter of the wall 237) of the second portion 202 of the conductor receiver 210. In such a case, the guide pin 265 can have a protruding feature 293 at the proximal end 290 of the guide pin 265. The protruding feature 293 can have an outer perimeter that is larger than the outer perimeter of the distal end 291 of the guide pin 265.

In certain example embodiments, between the distal end 291 and the protruding feature 293 (or the proximal end 290 if there is no protruding feature 293), the outer perimeter of the guide pin 265, defined by the outer surface 292, is substantially the same along such length of the guide pin 265. In certain example embodiments, the outer perimeter of the guide pin 265 between the distal end 291 and the protruding feature 293 is slightly less than the inner perimeter of the wall 220 of the first portion 201 of the conductor receiver 210. In addition, the outer perimeter of the guide pin 265 between the distal end 291 and the protruding feature 293 can be less than the outer perimeter of the conductive pin 255.

When the guide pin 265 includes a protruding feature 293, the shape of the protruding feature 293, when viewed cross sectionally, can be the same or different than the guide pin shape. In certain example embodiments, the size of the protruding feature 293 increases along the protruding feature 293 from the distal end 291 to the proximal end 290. Toward the proximal end 290 of the guide pin 265, the size (the outer perimeter) of the protruding feature 293 can be as large as, or slightly larger than, the outer perimeter of the conductive pin 255.

The protruding feature 293 can exist over the entire perimeter of the guide pin 265, or only over certain portions of the guide pin 265. For example, for the cross-sectional view shown in FIG. 2A, the protruding feature 293 could exist over the entire perimeter of the guide pin 265. In such a case, only the size (and not the shape) of the guide pin 265 changes over the protruding feature 293 when compared to the distal portions of the guide pin 265 away from the protruding feature 293. As one example alternative, there could be a protruding feature 293 only on the top and bottom portions of the outer surface of the guide pin 265. In such a case, where the protruding feature 293 begins, both the size and shape of the guide pin 265 changes at the protruding feature 293 when compared to the distal portions of the guide pin 265 away from the protruding feature 293.

In the latter example above, the protruding feature 293 can have a width that allows the protruding feature 293 to slide, when oriented with the slot 232, along the slot 232 when the conductor 250 is being slidably coupled to the conductor receiver 210. In such a case, if the protruding feature 293 is not oriented with the slot 232, then the conductor 250 may not be slidably coupled to the conductor receiver 210. In other words, a specific orientation or discrete number of orientations between the protruding feature 293 and the slot 232 may be required to mechanically couple the conductor 250 to the conductor receiver 210.

Alternatively, or in addition, a particular orientation between the protruding feature 293 and the slot 232 is not required in order to couple the conductor 250 to the conductor receiver 210. In such a case, the profile of the protruding feature 293 is ramped (i.e., the size of the protruding feature shape gradually increases from the distal end of the protruding feature 293 to the proximal end of the protruding feature 293) to widen the slot 232 and increase the size of the inner perimeter of the wall 235 (increase the cavity 270) of the ring portion 202.

As an example, as the guide pin 265 is inserted into the second portion 202 of the conductor receiver 210, the distal end 291 of the guide pin 265 is inserted with little or no resistance because the outer perimeter of the distal end 291 of the guide pin 265 is less than the inner perimeter of the ring portion 202 of the conductor receiver 210. As the guide pin 265 continues to be inserted, the protruding feature 293 begins to enter the ring portion 202. Because the size of the protruding feature shape gradually increases from the distal end of the protruding feature 293 to the proximal end of the protruding feature 293, and because the size of the protruding feature shape at the proximal end of the protruding feature 293 (the outer perimeter of the protruding feature 293 at the proximal end) is greater than the inner perimeter of the wall 235 of the ring portion 202 in a normal state, the protruding feature 293 applies an outward force on the wall 270 and increases the inner perimeter of the wall 235 of the ring portion 202.

As the conductor 250 is slid further inward with respect to the conductor receiver 210, the protruding feature 293 leaves the ring portion 202 and enters the gap portion 203 (or the base portion 201 if there is no gap portion 203 or if the gap portion 203 is combined with the base portion 201). At that moment, because the outer perimeter of the protruding feature 293 at the proximal end is at least as great as the outer perimeter of the conductive pin 255, and because the wall 270 of the ring portion 202 is made of a compressive material (i.e., the wall 270 has a tendency to return to its size and shape in a normal state, without outward or inward forces being applied), the size of the wall 270 conforms to the size of the conductive pin 255. In other words, as the outward force of the protruding feature 293 is no longer being applied, the wall 270 tries to return to its size and shape in a normal state. However, because the conductive pin 255 immediately follows the protruding feature 293, and because the outer perimeter of the conductive pin is larger than the inner perimeter of the wall 235 of the ring portion 202 in a normal state, the conductive pin 255 applies a lesser outward force on the wall 270. As a result, more complete contact is made between the inner surface of the wall 270 of the second portion 202 and the outer surface of the conductive pin 255.

When the guide pin 265 completely passes through the ring portion 202, some stop feature in the base portion 201 (or in the gap portion 203 when the gap portion 203 exists) is used to prevent the guide pin 265 from entering further into the conductor receiver 210. Put another way, the guide pin 265 is secured within a stop zone. For example, as shown in FIGS. 2A and 2C, a channel 230 may exist in the gap portion 203. The channel 230 can be a slot or opening that runs along all or a portion of the width of the wall 222 of the gap portion 203.

In certain example embodiments, the channel 230 is sized and positioned in such a way as to allow the guide pin 265 to pass therethrough. However, the channel 230 is also sized and positioned in such a way as to prevent the protruding feature 293 from passing therethrough. As such, the channel 230 provides a maximum point into the conductor receiver 210 that the conductor 250 can pass. The channel 230 can also include one or more features that hold the protruding feature 293 in place so that some amount of force is required to remove the conductor 250 from the conductor receiver 210.

In addition, or in the alternative, other features can exist in the conductor receiver 210 to limit the distance that the conductor 250 is inserted into the conductor receiver 210 and/or to lock the conductor 250 in place within the conductor receiver 210. For example, at least one protrusion, as described above with respect to FIG. 1, can be part of a wall within the conductor receiver 210. As another example, a feature (e.g., a notch, a slot) can be disposed on the guide pin 265 and/or the conductive pin 255.

Figure 3:
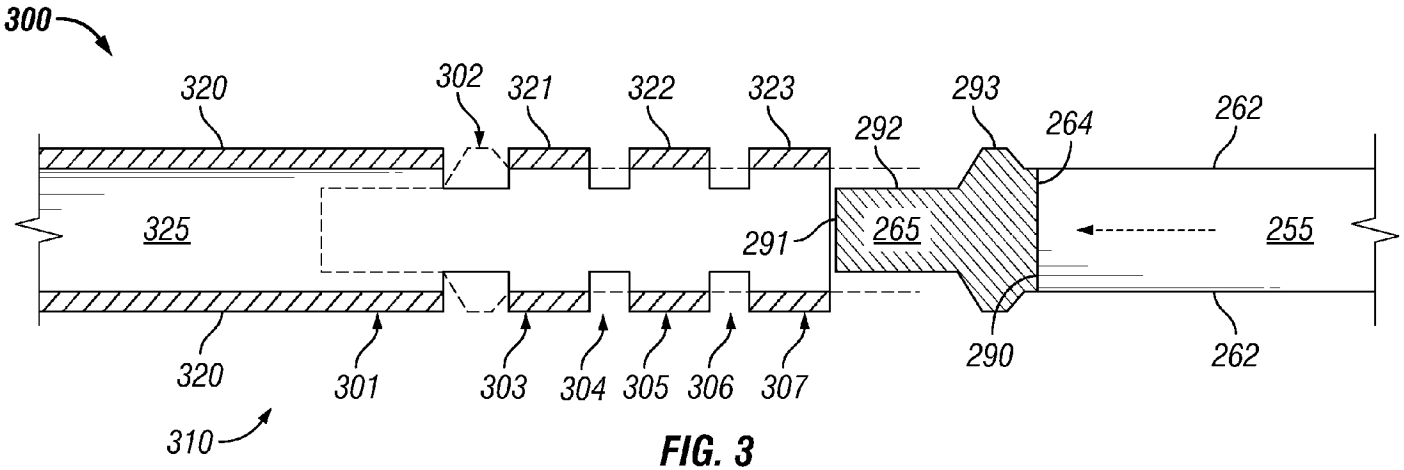
FIG. 3 shows a cross-sectional side view of another alternative example electrical connector in accordance with certain example embodiments.

FIG. 3 shows a cross-sectional side view of another alternative example electrical connector 300 in accordance with certain example embodiments. The electrical connector 300 of FIG. 3 is substantially similar to the electrical connector 200 of FIGS. 2A-C, with the differences described below. For example, the conductor receiver 310 includes a wall 320 that forms a cavity 325. Generally, the conductor receiver 310 of FIG. 3 has multiple ring portions and multiple gap portions, as opposed to a single ring portion and a single gap portion.

The conductor receiver 310 in FIG. 3 has a number of expandable and collapsible ring portions (e.g., ring portion 303, ring portion 305, ring portion 307, which have substantially similar properties, and behave in a substantially similar manner, as the ring portion 202 of FIGS. 2A-C. The walls (e.g., wall 321, wall 322, wall 323) of the respective ring portions can include one or more slots (not shown), substantially similar to the slot 232 described above with respect to FIGS. 2A-C, that traverses some or all of the length of each wall. The slot in each wall can allow the inner perimeter of the wall of the respective ring portion to expand or contract, depending upon whether an outward force is applied (i.e., whether the guide pin 265 is being inserted) to the respective ring portion. The slots can also allow some or all of the guide pin 265 to pass therethrough. Each slot can have the same or different dimensions when compared with the other slots.

In addition, or in the alternative, the length of the perimeter (e.g., inner surface, outer surface) of each ring portion can be the same or different from each other. The inner surface of each ring portion can be oriented (e.g., parallel to the outer surface of the conductive pin 255) and have properties (e.g., smooth) that promote contact between the ring portions and the conductive pin 255. In such a case, there is reduced temperature rise that results because of the more solid contact between the conductor receiver 310 and the conductor pin 255. In certain example embodiments, the size and shape of the inner surface of each ring portion corresponds to the size and shape of a portion of the conductive pin 255 that aligns with the ring portion when the conductive pin 255 is fully inserted into the conductor receiver 310.

Similar to the second section 203 described above with respect to FIGS. 2A-C, the conductor receiver 310 in FIG. 3 has a gap portion (e.g., gap portion 302, gap portion 304, gap portion 306) positioned between each ring portion. For example, gap portion 304 is positioned between ring portion 303 and ring portion 305. As with the gap portion 203 of FIGS. 2A-C, each gap portion of the conductor receiver 310 can include a wall that encloses a cavity and one or more channels. The wall in each gap portion can form a receiver shape (e.g., circle, ellipse, square, triangle, hexagon, star) when viewed in cross section. The receiver shape on the inner surface (inside) of the wall has an inner perimeter. Likewise, the outer surface (outside) of the wall of each gap portion can have an outer perimeter. Each channel of the each gap portion can traverse some or all of the length of the portion. The channel of each gap portion allows one or more portions of the guide pin 265 to pass therethrough and/or to not pass therethrough. In certain example embodiments, the channel of a gap portion has the same width and/or aligns with the slot of a ring portion.

With multiple ring portions, each separated by gap portions, instead of a single ring portion, the conductor receiver 310 can make better contact with the conductor pin 255. As a result, less of the power transferred between the conductor receiver 310 and the conductor pin 255 is lost to heat, which reduces the temperature rise of the electrical connector 300.

Figure 4B:
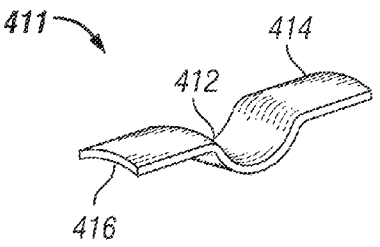
FIGS. 4A and 4B show various views of still another alternative example electrical connector in accordance with certain example embodiments.
Figure 4A:
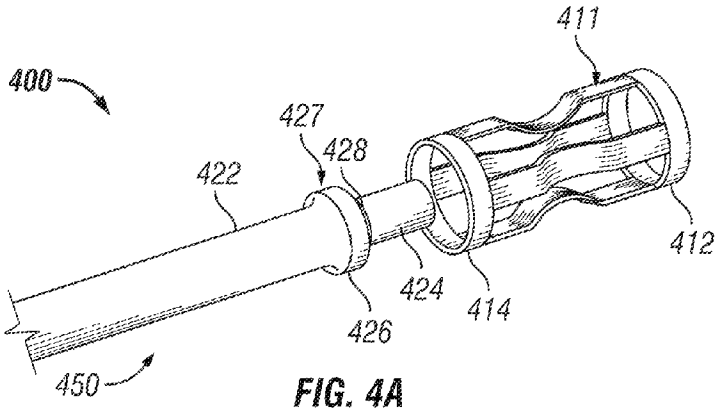

FIGS. 4A and 4B show various views of still another alternative example electrical connector 400 in accordance with certain example embodiments. Specifically, FIG. 4A shows a side perspective view of the electrical connector 400 that includes a contact basket 410, and FIG. 4B shows a side perspective view of contact segment 411 of a contact basket 410. In one or more embodiments, one or more of the components shown in FIGS. 4A and 4B may be omitted, repeated, and/or substituted. Accordingly, embodiments of electrical connectors having an example reduced temperature rise system should not be considered limited to the specific arrangements of components shown in FIGS. 4A and 4B.

The conductor 450 in this example is an elongated member having several features and made of one or more of a number of electrically conductive materials. The features of the conductor 450 can include, but are not limited to, a proximal end 422, a distal end 424, and a ramp 427. In certain example embodiments, the proximal end 422 and the distal end 424 of the conductor 450 are substantially similar to the conductive pin described above with respect to FIGS. 1-3. In this case, the perimeter of the distal end 424 of the conductor 450 is less than the perimeter of the proximal end 422. In other words, if the distal end 424 and the proximal end 422 have a substantially circular cross-sectional shape, then the diameter of the distal end 424 is smaller than the diameter of the proximal end 422.

In certain example embodiments, the ramp 427 is positioned between the proximal end 422 and the distal end 424. The ramp 427 can include a proximal transition portion 425, a distal transition portion 428, and a center portion 426. The center portion 426 can have one or more of a number of shapes along its outer surface. Examples of such shapes can include a flat plane (as shown in FIG. 4A), a point, and a rounded surface. The outer perimeter of the center portion 426 is greater than the perimeter of the distal end 424 (in cross section). Further, the outer perimeter of the center portion 426 is at least the same as the perimeter of the proximal end 422 (in cross section).

The proximal transition portion 425 provides a smooth outer surface between the proximal end 422 and the center portion 426. Similarly, the distal transition portion 428 provides a smooth outer surface between the distal end 424 and the center portion 426. When the outer perimeter of the center portion 426 is approximately the same as the perimeter of the distal end 424, then the ramp 427 may only include the distal transition portion 428 and not the center portion 426 or the proximal transition portion 425.

The distal end 424 and the ramp 427 can be made of one or more of any types of materials. Such materials can be electrically conductive and/or electrically non-conductive. In certain example embodiments, the proximal end 422 is made of electrically conductive material. The proximal end 422 can have a length greater than the combined length of the ramp 427 and the distal end 424.

The conductor receiver in this example is a contact basket 410. The contact basket 410 includes a number of contact segments 411 that are arranged circumferentially around and between a proximal end piece 414 and a distal end piece 412. The proximal end piece 414 and the distal end piece 412 can have a cross-sectional shape that is substantially similar to the cross-sectional shape of the center portion 426 of the ramp 427, the distal end 424 of the conductor 450, and/or the proximal end 422 of the conductor 450. Further, the perimeter of the proximal end piece 414 is greater than the perimeter of the center portion 426 of the ramp 427. In certain example embodiments, the shape and size of the proximal end piece 414 is substantially the same as the shape and size of the distal end piece 412.

Each of the contact segments 411 can include a distal end 414, a proximal end 416, and a center portion 412. In certain example embodiments, the distal end 414, the proximal end 416, and the center portion 412 have a curved profile that is substantially similar to the profile of the outer surface of the proximal end 422 of the conductor 450 and/or the center portion 426 of the ramp 427. In some cases, the distal end 414 of the contact segment 411 has a profile that is different than the profile of the proximal end 416 and/or the center portion 412.

Each contact segment 411 is shaped and oriented such that the center portion 412 is directed inward (toward the axial center that runs between the distal end 414 and the proximal end 416) relative to the distal end 414 and the proximal end 416. Further, the profile of each contact segment 411 is oriented such that both edges of the contact segment are directed inward relative to the middle (lengthwise) of the contact segment 411. In addition, the inner perimeter formed by the center portions 412 of the contact segments 411 is at least slightly smaller than the outer perimeter of the center portion 426 of the ramp 427 (or the outer perimeter of the proximal end 422 of the conductor 450 if there is no center portion 426 of the ramp 427).

In certain example embodiments, the contact segments 411 (and, in some cases, the distal end 414 and the proximal end 416) are made of electrically conductive material. In addition, the contacts segments 411 are rigid with an amount of flex. Specifically, as the conductor 450 is inserted into the proximal end 416 of the contact basket 410, the ramp 427 is drawn toward the center portion 412 of each contact segment 411. Because the contact segments 411 are made of a material that allows for some flex, and because the inner perimeter formed by the center portions 412 of the contact segments 411 is at least slightly smaller than the outer perimeter of the center portion 426 of the ramp 427, the center portions 412 of the contact segments 411 expand outward and allow the ramp 427 to pass therethrough as the conductor 450 is inserted further into the contact basket 410.

When the center portion 426 of the ramp 427 has passed beyond the center portions 412 of the contact segments 411, the center portions 412 of the contact segments 411 collapse onto the outer surface of the proximal end 422 of the conductor 450 because the outer perimeter of the proximal end 422 of the conductor 450 is less than the outer perimeter of the center portion 426 of the ramp 427. Consequently, the center portions 426 of the ramps 427 increase the contact area and reduce the contact resistance between the conductor 450 and the contact basket 410. As a result, a reduction in temperature rise results for the electrical connector 400.

Figure 5B:
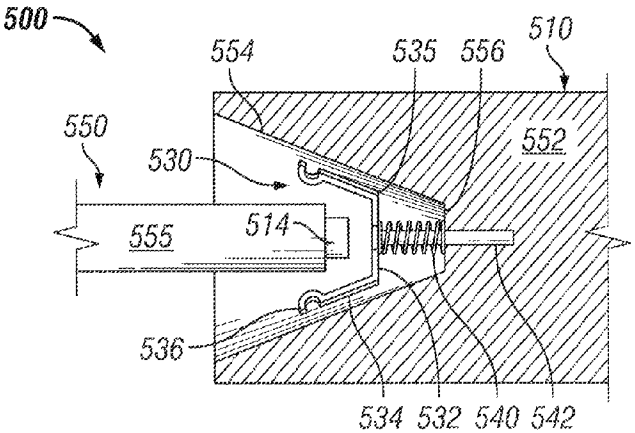
FIGS. 5A and 5B show various views of yet another alternative example electrical connector in accordance with certain example embodiments.
Figure 5A:
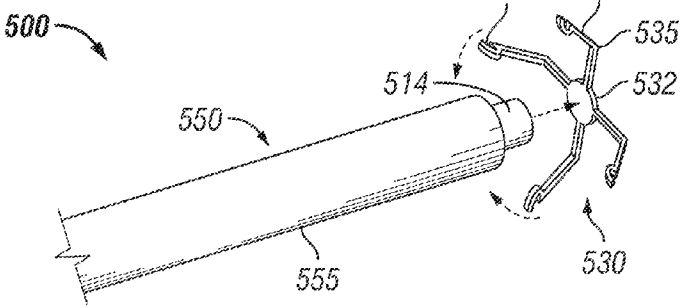

FIGS. 5A and 5B show various views of yet another alternative example electrical connector 500 in accordance with certain example embodiments. Specifically, FIG. 5A shows a side perspective view of the electrical connector 500 that includes a webbed clip 530, and FIG. 5B shows a cross-sectional side view of the electrical connector 500. In one or more embodiments, one or more of the components shown in FIGS. 5A and 5B may be omitted, repeated, and/or substituted. Accordingly, embodiments of electrical connectors having an example reduced temperature rise system should not be considered limited to the specific arrangements of components shown in FIGS. 5A and 5B.

The conductor 550 in this example is an elongated member having several features and made of one or more of a number of electrically conductive materials. The features of the conductor 550 can include, but are not limited to, an extension 514 positioned at the distal end and a conductive pin 555 mechanically coupled to the extension 514. In certain example embodiments, the pin 555 and the extension 514 of the conductor 550 are substantially similar to the conductive pin and guide pin, respectively, described above with respect to FIGS. 2A-3. In this case, the perimeter of the extension 514 of the conductor 550 is less than the perimeter of the conductive pin 555. In other words, if the extension 514 and the conductive pin 555 have a substantially circular cross-sectional shape, then the diameter of the extension 514 is smaller than the diameter of the conductive pin 555.

The extension 514 can be made of one or more of any types of materials. Such materials can be electrically conductive and/or electrically non-conductive. The shape and size of the extension 514 can vary, depending on one or more of a number of factors, including but not limited to the width of the base 532 of the webbed clip 530, the location of the hinged features 535 along the clip arms 534, the length of the clip arms 534, the length of the clip fingers 536, and the angle between the interior wall 556 and the angled portions 554 of the compression member 554. In certain example embodiments, the conductive pin 555 is made of electrically conductive material. The conductive pin 555 can have a length greater than the length of the extension 514.

The conductor receiver 510 in this example includes a webbed clip 530. The webbed clip 530 is positioned inside a space created by a compression member 554 of a body 552 that is substantially similar to the compression member 165 described above with respect to FIG. 1. In this case, however, the compression member 554 is part of the conductor receiver 510 (as opposed to being part of the conductor, as is the case of the compression member 165 in FIG. 1). An electrically conductive element 542 traverses the length of a cavity within the body 552 and is positioned substantially along the center of the body 552. In certain example embodiments, the electrically conductive element 542 is slidably positioned within the cavity in the body 552.

At the proximal end of the conductor receiver 510, the electrically conductive element 542 extends beyond the interior wall 556 of the compression member 554. The proximal end of the electrically conductive element 540 is mechanically coupled to the base 532 of the webbed clip 530. In addition, a compressive element 540, such as a spring, is coupled to the base 532 of the webbed clip 530 and the electrically conductive element 542 in such a way as to apply a compressive force that pushes the webbed clip 530 away from the interior wall 556 of the compression member 554.

For example, if the compressive element 542 is a spring, then the spring can be wrapped around the portion of the electrically conductive element 542 that protrudes through the interior wall 556 of the compression member 554. In such a case, the proximal end of the spring may be mechanically coupled to the back side of the base 532 of the webbed clip 530. Alternatively, the proximal end of the spring may be mechanically coupled to the interior wall 556 of the compression member 554. As yet another alternative, neither end of the spring may be fixedly coupled to anything.

In addition to the base 532, the webbed clip 530 can include a number of clip arms 534 and a number of clip fingers 536. The distal end of each clip arm 534 can be mechanically coupled to the base 532, and the proximal end of each clip arm 534 can be mechanically coupled to one or more clip fingers 536. The distal end of each clip arm 534 can be mechanically coupled to one or more of a number of points along the base 532, including but not limited to the outer edge of the base 532, the front side of the base 532, and the back side of the base 532.

Each clip arm 534 can include one or more hinged features 535 that allow the clip fingers 536 to collapse onto and contact the conductive pin 555 when the extension 514 applies an inward force to the base 532 of the webbed clip 530. A hinged feature 535 can be positioned at any point along a clip arm 534. For example, a hinged feature 535 can be positioned approximately ⅓ the distance of the clip arm 534 from the distal end of the clip arm 534, as shown in FIGS. 5A and 5B. As another example, a hinged feature 535 can be positioned where the distal end of the clip arm 534 couples to the base 532 of the webbed clip 530.

As the conductor 550 is moved laterally toward the conductor receiver 510, the compression member 554 contacts the base 532 of the webbed clip 530. If the force applied by the conductor 550 (and thus the extension 514) is greater than the compressive force applied by the compressive element 540 on the base 532, then the compressive element 542 compresses as the webbed clip 530 is forced inward toward the interior wall of the compression member 554. As the webbed clip 530 is forced inward toward the interior wall of the compression member 554, the clip arms 534 contact the angled walls of the compression member 554. When the clip arms 534 contact the angled portions 554 of the compression member 554, the hinged features 535 allow the proximal portions of the clip arms 534 (and so also the clip fingers 536 coupled to the proximal end of the clip arms 534) to collapse toward the conductive pin 555.

The clip fingers 536 and the clip arms 534 are made of one or more of a number of electrically conductive materials. The base 532 of the webbed clip 530 can be made, at least in part, of electrically conductive material. For example, if the clip arms 534 are mechanically coupled to the outer edge of the base 532 or to the back side of the base 534, the back side of the base 534 can be made of electrically conductive material, while the front side of the base 534 can be made of electrically non-conductive material.

When the clip fingers 536 contact the conductive pin 555, power can flow between the conductor 550 and the conductor receiver 510. The clip fingers 536 can be of any size (e.g., length, width) and shape (e.g., having a curvature to mirror the curvature of the conductive pin 555) to increase the surface contact between the clip fingers 536 contact the conductive pin 555. As a result, a reduction in temperature rise results for the electrical connector 500.

In certain example embodiments, when the conductor 550 is fully inserted (or inserted beyond a certain point) within the conductor receiver 510, the force applied by the clip fingers 536 on the conductive pin 555 is greater than the compressive force applied by the compressive element 540. In such a case, the conductor 550 stays engaged with the conductor receiver 510 without any external influence or force. In certain example embodiments, a locking feature (not shown) may be included to help hold the conductor 550 and the conductor receiver 510 in an engaged position and allow electricity to flow between them without interruption. Such a locking feature can be controlled externally from the electrical connector 500 (e.g., as from a switch or pushbutton) and/or internal to the electrical connector 500 (e.g., features along the outer surface of the conductive pin 555 that allow some or all of the clip fingers 536 to sink into the outer perimeter of the conductive pin 555).

FIGS. 6A-D show various views of yet another alternative example electrical connector 600 in accordance with certain example embodiments. Specifically, FIGS. 6A-D show various side views of the electrical connector 600. In one or more embodiments, one or more of the components shown in FIGS. 6A-D may be omitted, repeated, and/or substituted. Accordingly, embodiments of electrical connectors having an example reduced temperature rise system should not be considered limited to the specific arrangements of components shown in FIGS. 6A-D.

The conductor 650 in this example is an elongated member that can have several features and be made of one or more of a number of electrically conductive materials. The features of the conductor 650 can include, but are not limited to, a conductive pin 655 and an optional extension (not shown) (such as described above with respect to FIGS. 5A and 5B) or guide pin (not shown) (such as described above with respect to FIGS. 2A-3), positioned at and mechanically coupled to the distal end of the conductive pin 655. In certain example embodiments, the conductive pin 655 of the conductor 650 is substantially similar to the conductive pin described above with respect to FIGS. 1-5B.

The conductor receiver 620 in this example includes a meshing 624 that is fixedly coupled to a collar 622 at the proximal end of the meshing 624. The meshing 624 is also fixedly coupled to a collar 626 at the distal end of the meshing 624. In certain example embodiments, the collar 622 is a rigid member that forms an opening through which some or all of the conductive pin 655 can pass through. In other words, the inner perimeter of the collar 622 is larger than the outer perimeter of the conductive pin 655. The collar 622 can be made of one or more of a number of materials. Such materials can be electrically conductive and/or electrically non-conductive. The shape of the opening of the collar 622 can be substantially the same as the cross-sectional shape of the conductive pin 655.

The collar 626 that is mechanically coupled to the distal end of the meshing 624 can be substantially the same as the collar 622. Alternatively, one or more features of the collar 626 can be different than the corresponding features of the collar 622. For example, the collar 626 can be a solid piece that has no opening. As another example, the collar 622 can be made of electrically non-conductive material, where the collar 626 can be made of electrically conductive material.

Figure 6A:
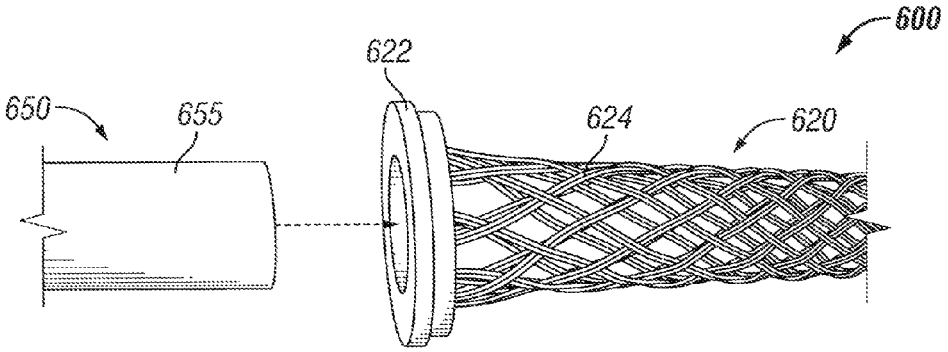
FIGS. 6A-D show various views of still another alternative example electrical connector in accordance with certain example embodiments.
Figure 6B:
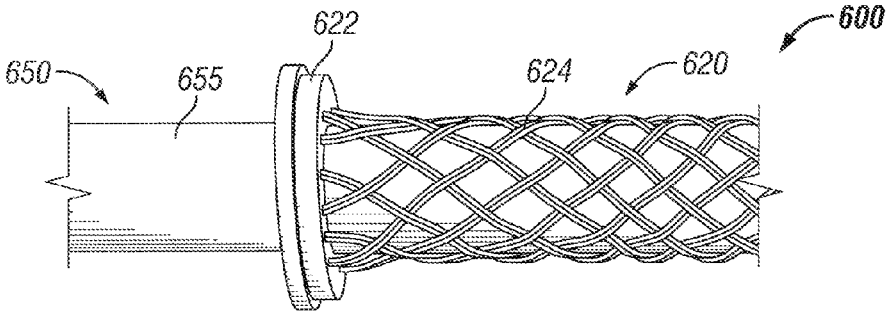

In certain example embodiments, the meshing 624 is made of one or more of electrically conductive materials. The meshing 624 can also be made of flexible material, so that the meshing 624 can be stretched. The material of the meshing 624 can also be resilient, which would allow the meshing, after being stretched for an extended period of time, to return to substantially its original unstretched shape and size when the meshing 624 is unstretched. The strands of the meshing 624 can be of any dimensions (e.g., thickness, height). The strands of the meshing 624 can be single strands or multiple strands paired to each other. For example, as shown in FIGS. 6A and 6B, each of the strands of the meshing 624 are two strands paired side by side. The spacing between the strands of the meshing 624 can be of any suitable distance. The strands of the meshing 624 can be positioned to create a substantially regular pattern (as shown in FIGS. 6A-D) and/or an irregular pattern.

Figure 6C:
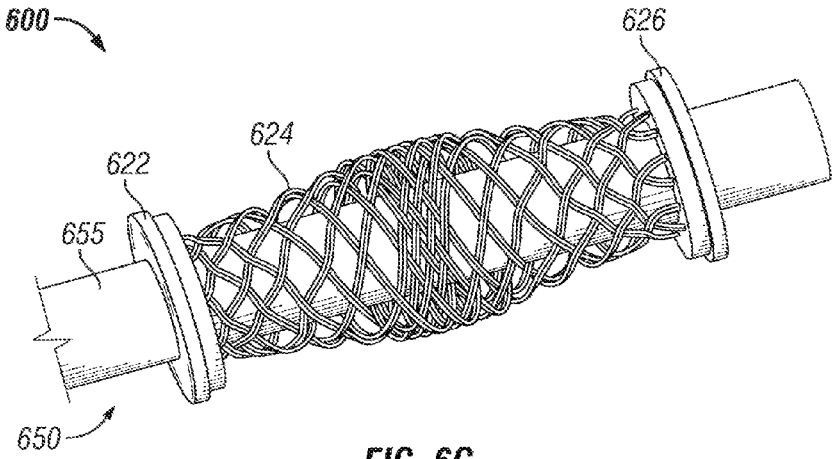

As can be seen in FIGS. 6A-D, the meshing 624 forms a cavity. In certain example embodiments, in a relaxed or normal state (i.e., when the meshing 624 is not stretched), cavity formed by the meshing 624 has substantially the same shape and size as the collar 622 and/or the collar 626. In some cases, such as the example shown in FIG. 6C, the meshing 624 bows outward toward the middle in an unstretched state. In such a case, as shown in FIG. 6C, the conductive pin 655 can traverse the opening of the collar 622 and the cavity of the meshing 624 with little or no contact with the collar 622 or the meshing 624. As a result, the force required to insert the conductive pin 655 (also called the insertion force) through the opening of the collar 622 and the cavity of the meshing 624 is very low. In certain example embodiments, the conductive pin 655 extends beyond the collar 626 when the conductive pin 655 is fully inserted This additional advantage (a low or zero insertion force) of the electrical connector 600 is beneficial for a few reasons. First, a reduced insertion force creates less wear on the conductor 650 and the conductor receiver 620. As such, the mechanical integrity of the components of the conductor 650 and the conductor receiver 620 lasts for a longer period of time and/or for a greater number of connections and disconnections of the conductor 650 and the conductor receiver 620. In addition, if the electrical connector 600 is rated for a higher amperage and/or voltage, the size and weight of the conductor 650 and the conductor receiver 620 can be significant. As such, mechanically coupling the conductor 650 and the conductor receiver 620 becomes significantly easier for a user when the insertion force required for such coupling is so low.

In certain example embodiments, when the conductive pin 655 is inserted into the opening of the collar 622 and the cavity of the meshing 624, the meshing 624 can make contact with the conductive pin 655 by stretching the meshing 624.

Figure 6D:
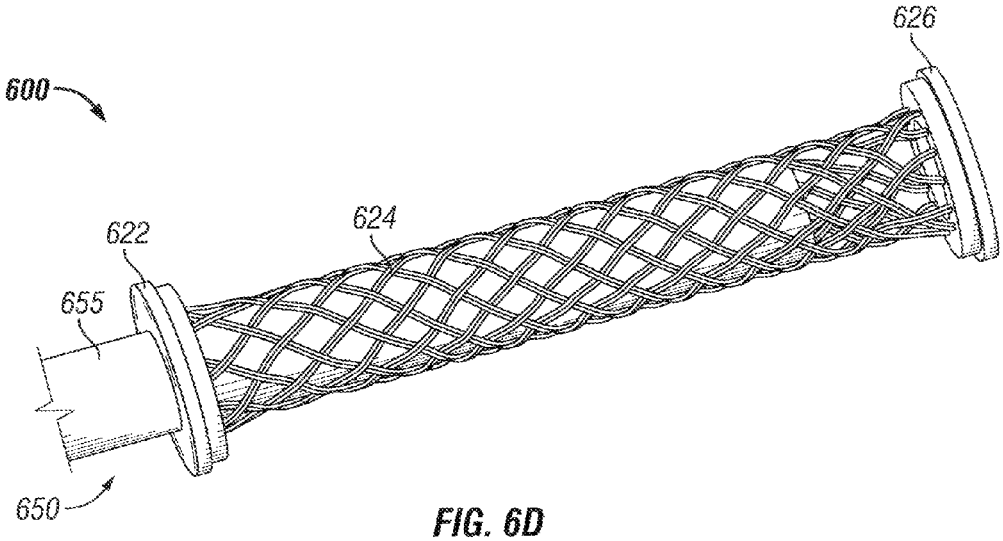

When the meshing 624 is stretched into a stretched state, as shown in FIG. 6D, the meshing 624 makes consistent contact with the conductive pin 655 along most of the length of the conductive pin 655. In such a case, the collar 626 can extend beyond the distal end of the conductive pin 655.

One such way to stretch the meshing 624 is by pulling the collar 626 in a direction laterally away from the collar 622. When the meshing 624 is stretched (in this example, by the linear displacement of the collar 626), the cavity formed by the meshing 624 collapses (is reduced in size). The more the meshing 624 is stretched, the more the size of the cavity formed by the meshing 624 is reduced. Eventually, the stretched meshing 624 comes into direct contact with the outer surface of the conductive pin 655.

The surface area covered by the meshing 624 on the outer surface of the conductive pin 655 is significant. Further, the surface contact of the meshing 624 along and around the conductive pin 655 is substantially uniform. As a result, a reduction in temperature rise results for the electrical connector 600.

As a variation to the example embodiment using meshing described above with respect to FIGS. 6A-D, the conductor receiver can include one or more comb-like structures made of an electrically conductive material. The comb-like structure can have a base that is electrically coupled to a cable, breaker switch, or some piece of electrical equipment. Extending from the base at some angle (e.g., perpendicular to the base) can be a number of "teeth" of the comb-like structure. These "teeth" can also be made of an electrically conductive material and have a curvature that is substantially similar to the curvature of the conductive pin. The "teeth" can act as a living hinge, so that as the conductive pin is inserted into the conductor receiver, the "teeth" allow the conductive pin to be inserted with a low insertion force. At the same time, the "teeth" maintain an increased surface area of contact with the conductor receiver, improving the efficiency of electrical transfer between the conductor and conductor receiver, which reduces the temperature rise of the electrical connector. One or both of these aforementioned benefits reduces the amount of mechanical wear on the conductor and/or the conductor receiver using this example embodiment.

Figure 7A:
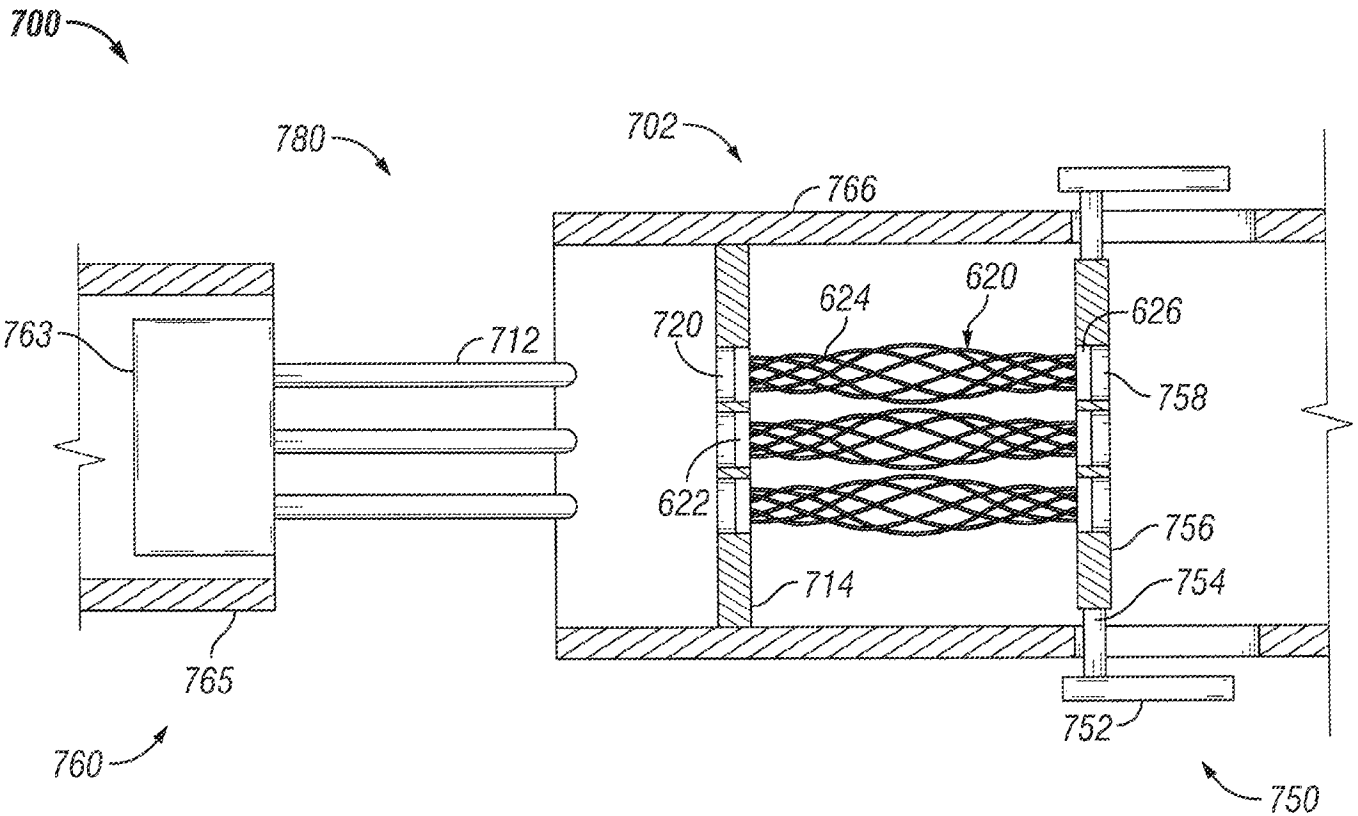
FIGS. 7A and 7B each shows a cross sectional side view of an electrical connector system using the example conductor receiver of FIGS. 6A-D in accordance with certain example embodiments.
Figure 7B:
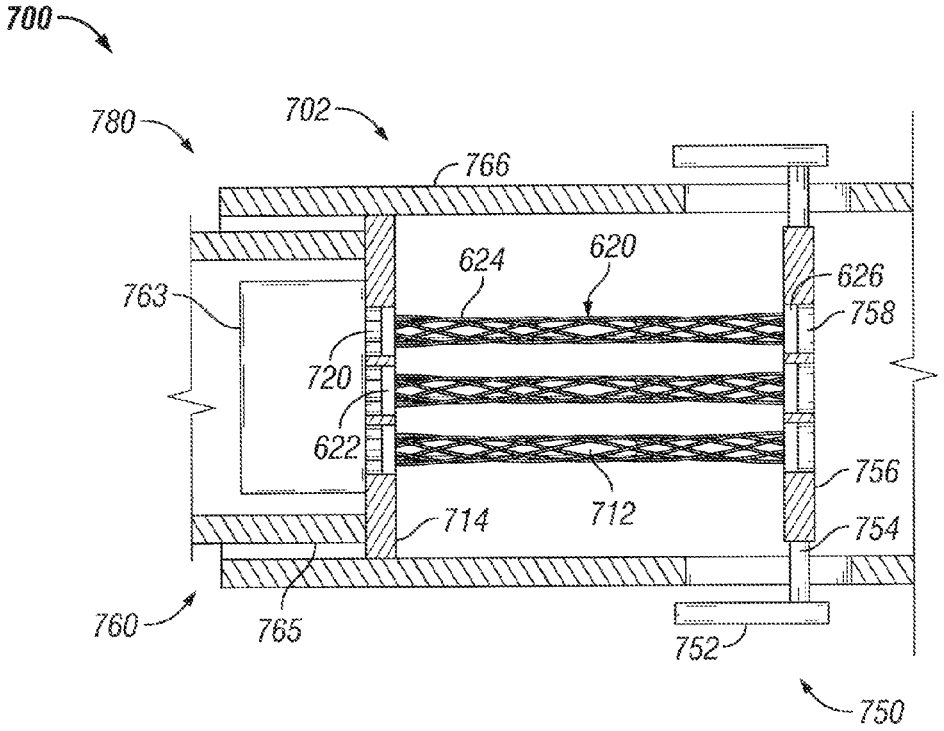

FIGS. 7A and 7B each shows a cross sectional side view of an electrical connector system 700 using the example conductor receiver 620 of FIGS. 6A-D in accordance with certain example embodiments. In one or more embodiments, one or more of the components shown in FIGS. 7A and 7B may be omitted, repeated, and/or substituted. Accordingly, embodiments of electrical connectors having an example reduced temperature rise system should not be considered limited to the specific arrangements of components shown in FIGS. 7A and 7B.

In the example shown in FIGS. 7A and 7B, the conductor 760 includes a housing 765 that encases three conductive pins 712 secured at their proximal end by a base element 763. In certain example embodiments, the housing 765 and the base element 763 are made of one or more of a number electrically non-conductive materials. The conductive pins 712 can be aligned substantially in parallel to each other. In addition, the conductive pins 712 can be spaced apart substantially enough to avoid arcing over (causing a fault or short circuit) and/or to comply with an applicable standard and/or regulation. The conductive pins 712 can be substantially similar to one or more of the conductive pins described above.

The conductor receiver assembly 702 shown in the example in FIGS. 7A and 7B includes a housing 766 that encases three conductor receivers 620 secured at their proximal end by a retainer 714 and at their distal end by a displacement collar assembly 750. In certain example, embodiments, the retainer 714 is fixedly coupled to the housing 766. In such a case, the displacement collar assembly 750 is slidably or otherwise movably coupled to the housing 766. The retainer 714 can be made of one or more of a number of electrically non-conductive materials. The housing 766 can be made of one or more of a number of electrically conductive and/or electrically non-conductive materials.

In this example, the proximal collar 622 of each conductor receiver 620 is positioned within and mechanically coupled to an aperture 720 that traverses the retainer 714. In addition, the distal collar 626 of each conductor receiver 620 is mechanically coupled to a base 756 of the displacement collar assembly 750. Each end of the base 756 is mechanically coupled to a guiding pin 754, which extends laterally away from the base 756. The opposite end of the guiding pin 754 is slidably coupled (or coupled in some other fashion, such as threadably, movably, or rotatably) to a slot of a track 752, which is held stationary relative to the housing 722. The track 752 can have one or more of a number of features to allow for movement of the base 756. Such features can include, but are not limited to, threads, detents, gears, and slots.

In an alternative embodiment, the track 752 is fixedly coupled to the guiding pin 754 and moves laterally with respect to the housing 766. In either case, the base 756 can be moved laterally to stretch and unstretch the meshing 624 of the conductor receiver 620. In yet another alternative embodiment, the guiding pin 754 is threadably coupled to the slot of the track 752, where rotation of the guiding pin 754, the slot of the track 752, and/or the track 752 itself causes lateral displacement of the base 756. The movement of the base 756 can be driven electrically and/or mechanically.

FIG. 7A shows the electrical connector system 700 when the meshing 624 is in an unstretched state, before the conductive pins 712 are inserted into the meshing 624. After the conductive pins 712 are inserted into the meshing 624, the meshing 624 is stretched into a stretched state, as shown in FIG. 7B. In certain example embodiments, the base 756 is moved (stretches/unstretches the meshing 624) based on an external control, such as a switch, a pushbutton, or an electronic signal. In other example embodiments, the base 756 is moved automatically. For example, once a conductive pin 712 is inserted a certain distance into the respective conductor receiver 620, a mechanism (not shown) is triggered to begin moving the base 756 and stretching the meshing 624. As another example, a sensor (not shown) detects that a conductive pin 712 is inserted a certain distance into the respective conductor receiver 620, can trigger a command to a controller to begin moving the base 756 and stretching the meshing 624.

In addition, a feature can be added to the electrical connector system 700 that would not allow electricity to flow between the conductive pin 712 and the conductor receiver 620 until the meshing 624 is stretched and in contact with the outer surface of the conductive pin 712. For example, a breaker (not shown) can be closed when the base 756 is laterally extended a certain distance. In such a case, closing the breaker can be triggered by a switch or by an electronic pulse generated by a controller. As another example, a manual switch can be operated by a user to close the electric circuit. In such a case, the manual switch can include a safety feature that prevents the user from turning the switch ON (closing the electric circuit) unless the conductor 760 is fully inserted into the conductor receiver assembly 702. As yet another example, there may be a mechanical linkage that is coupled to the collar 626 and/or a portion of the displacement collar assembly 750 and a mechanical switch.

In addition, as described above with respect to FIGS. 6A-D, this example embodiment of the electrical connector system 700 has the benefit of reducing the temperature rise of the electrical connector, as well as utilizing a low insertion force when mechanically coupling the conductor 760 to the conductor receiver housing 710.

Figure 8A:
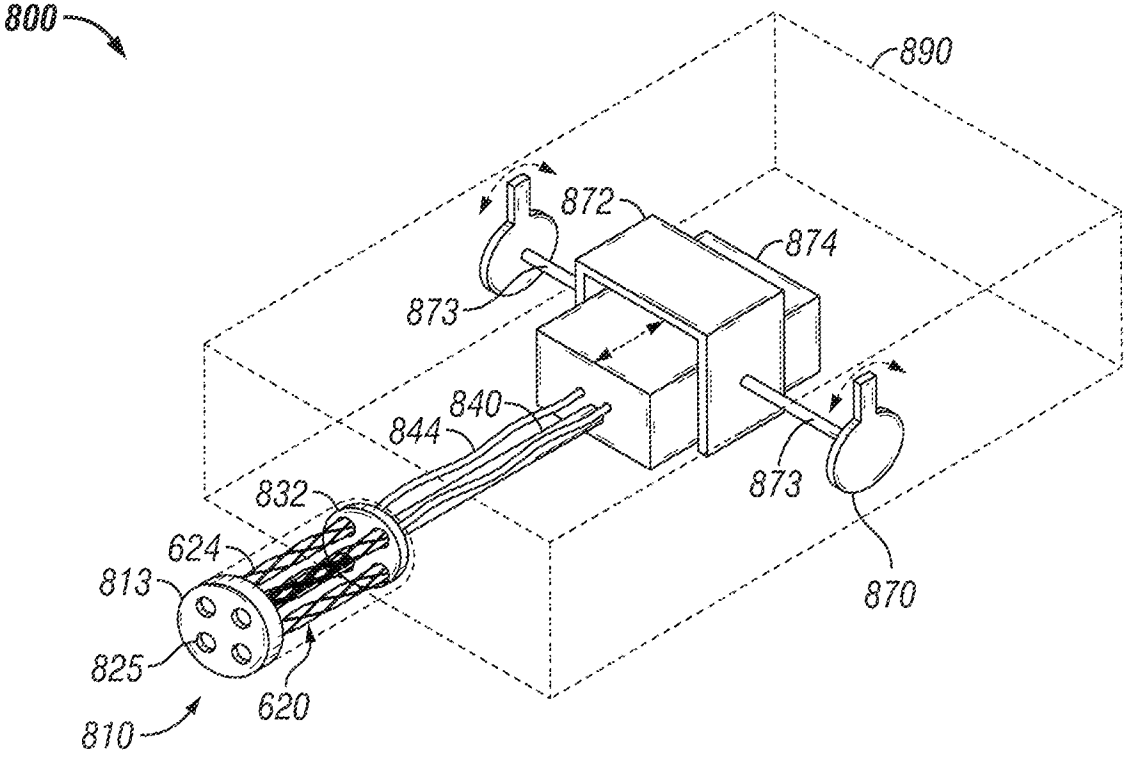
FIGS. 8A and 8B show various views of another electrical connector system using the example conductor receiver of FIGS. 6A-D in accordance with certain example embodiments.
Figure 8B:
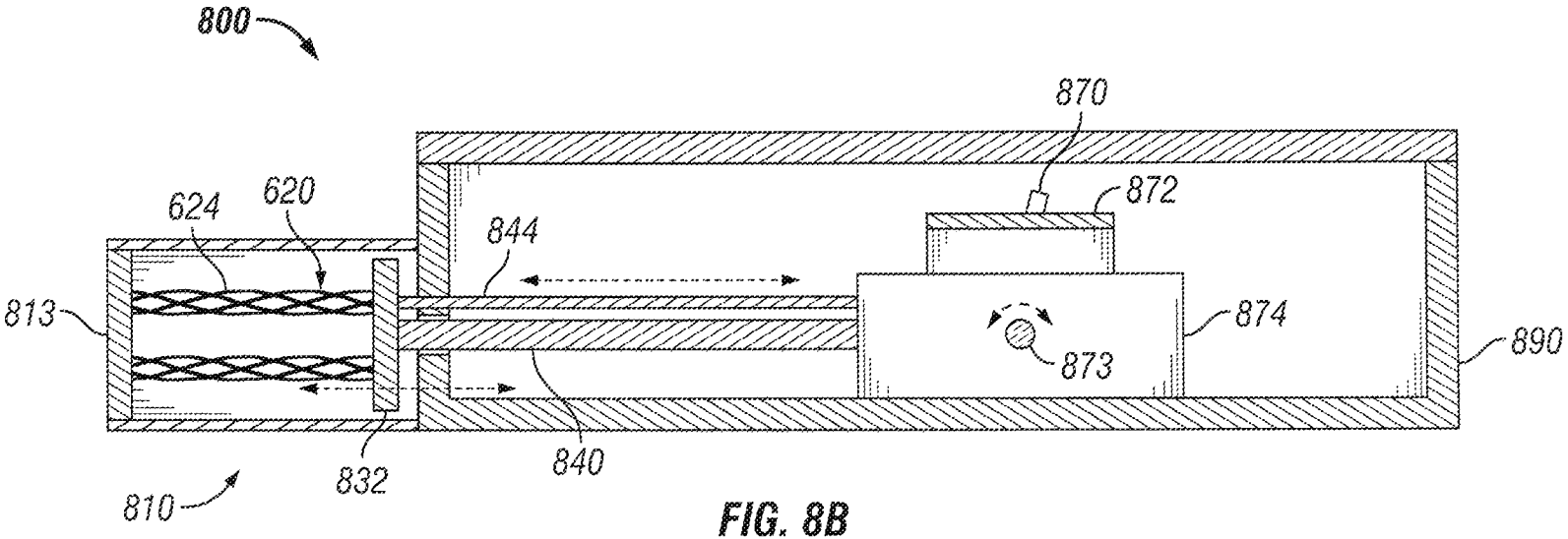

FIGS. 8A and 8B show various views of another electrical connector system 800 using the example conductor receiver 620 of FIGS. 6A-D in accordance with certain example embodiments. Specifically, FIG. 8A shows a top-side perspective view of the electrical connector system 800, and FIG. 8B shows a cross-sectional side view of the electrical connector system 800. In one or more embodiments, one or more of the components shown in FIGS. 8A and 8B may be omitted, repeated, and/or substituted. Accordingly, embodiments of electrical connectors having an example reduced temperature rise system should not be considered limited to the specific arrangements of components shown in FIGS. 8A and 8B.

In this example, the conductor is not shown, but is substantially similar to the conductors described above. The electrical connector system 800 shown in FIGS. 8A and 8B includes a conductor receiver housing 810 and an enclosure 890 that is adjacent to the conductor receiver housing 810. The conductor receiver housing 810 includes a fixed housing 811 and a fixed retainer 813 that is fixedly coupled to the fixed housing 811. The conductor receiver housing 810 can also include a floating retainer 832 that is positioned within, and is slidably coupled to, the fixed housing 811. In certain example embodiments, the floating retainer 832 can slide within the fixed housing 811 along a portion or the entire length of the fixed housing 811. The fixed retainer 813 can be made of one or more of a number of electrically non-conductive materials. The fixed housing 811 can be made of one or more of a number of electrically conductive and/or electrically non-conductive materials.

In this example, the proximal collar (not shown) of each conductor receiver 620 is positioned within and mechanically coupled to an aperture 825 that traverses the fixed retainer 813. In addition, the distal collar (not shown) of each conductor receiver 620 is mechanically coupled to the floating retainer 832 of the conductor receiver housing 810. In addition, the floating retainer 832 is coupled to a linking device 840, which traverses a distal wall of the conductor receiver housing 810. The linkage device 840 also traverses a proximal wall of the enclosure 890 and can be mechanically coupled, at the distal end, to a rigid member 872 with an axel 873 along a pivot point formed by the axel 873. In addition, or in the alternative, the linkage device 840 can be mechanically coupled to the mechanical switch 870 (described below).

The axel 873 can also be mechanically (e.g., rotatably) coupled to a breaker 874. The breaker 874 can be any type of electrical switch (e.g., a circuit breaker) or other electrical device. The breaker 874 can be fixedly positioned within the enclosure 890. The rigid member 872 can be movably (e.g., slidably, rotatably) coupled to the enclosure 890 and/or the linkage device 840. The movement of the rigid member 872 can be controlled by the mechanical switch 870. The mechanical switch 870 can be a cam or some other feature that can be activated by rotating, sliding, or otherwise changing the position of the mechanical switch 870. When the mechanical switch 870 is activated, the movement of the mechanical switch 870 causes the rigid member 872 to rotate, slide, or otherwise move to cause the lateral displacement of the linking device 840. When the rigid member 872 causes the lateral displacement of the linking device 840, the floating retainer 832 can be moved within the fixed housing 811 relative to the fixed retainer 813, which causes the meshing 624 of the conductor receiver 620 to be stretched/unstretched.

In addition, the rigid member 872, through the pivot point 873, can be mechanically coupled to the distal end of a number of conductors 844. In such a case, as shown in FIGS. 8A and 8B, the conductors 844 and/or the linkage device 840 can traverse a portion of the breaker 874. The proximal end of each conductor 844 can be mechanically coupled to the distal collar of the conductor receiver 620. Each conductor 844 has a length that is at least as long as the length of the linking device 840. In other words, each conductor 844 can be long enough so as to not cause the lateral movement of the floating retainer 832 (in place of the linking device 840). The distal end of the conductors 844 can traverse the breaker 874 or terminate within the breaker 874.

As described above, the switch 870 can change states manually and/or automatically. If the switch is a lever that rotates, then an axel 873 or some similar feature can be included to help cause the movement and/or state change of the switch 870 translate into lateral movement of the linking device 840, either directly or using the displacement feature. The switch 870 can be used to stretch the meshing 624. In addition, or in the alternative, the switch 870 can be used (directly or indirectly) to allow the flow of power between the conductor and the conductor receiver housing 810 only when the meshing 620 is stretched to the point where the meshing 620 makes solid contact with the conductive pin.

As with the embodiment described above with respect to FIGS. 7A and 7B, this example embodiment of the electrical connector system 800 has the benefit of reducing the temperature rise of the electrical connector, as well as utilizing a low insertion force when mechanically coupling the conductor to the conductor receiver housing 810.

Figure 9:
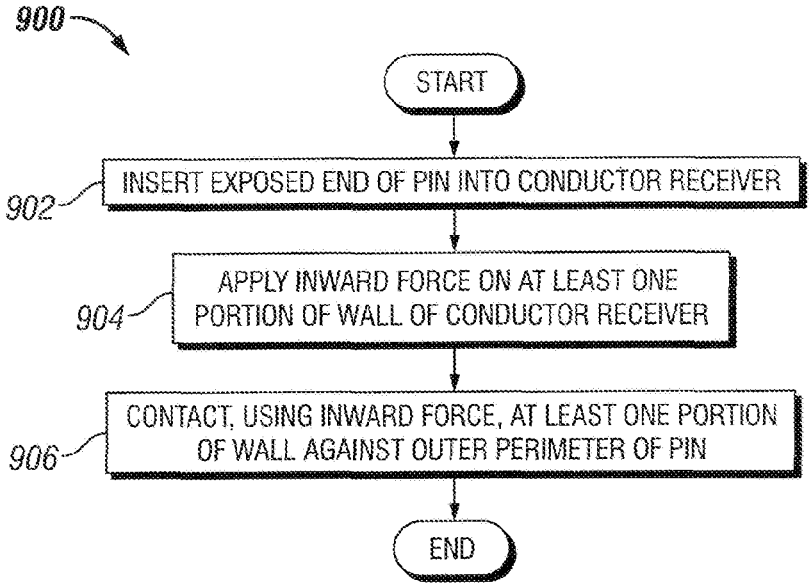
FIG. 9 shows a flowchart of a method for increasing a contact surface within an electrical connector in accordance with certain example embodiments.
Figure 10:
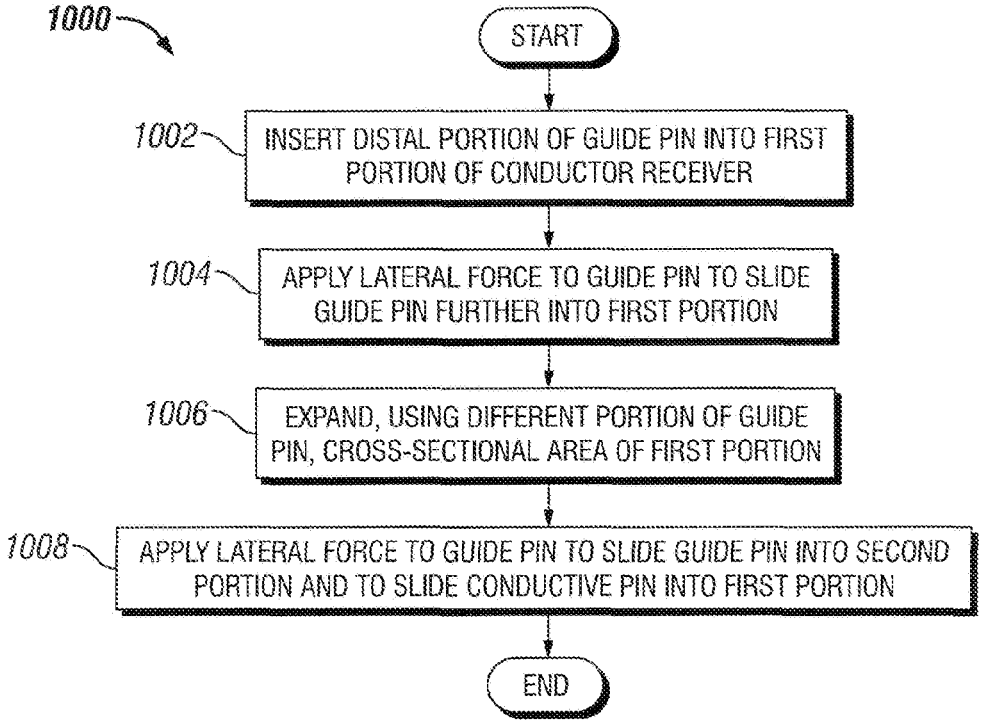
FIG. 10 shows a flowchart of an alternative method for increasing a contact surface within an electrical connector in accordance with certain example embodiments.

FIGS. 9 and 10 each shows a flowchart of a method for increasing a contact surface within an electrical connector in accordance with certain example embodiments. While the various steps in these flowcharts are presented and described sequentially, one of ordinary skill will appreciate that some or all of the steps may be executed in different orders, may be combined or omitted, and some or all of the steps may be executed in parallel. Further, in certain example embodiments, one or more of the steps described below may be omitted, repeated, and/or performed in a different order. In addition, a person of ordinary skill in the art will appreciate that additional steps, omitted in FIGS. 9 and 10, may be included in performing these methods. Accordingly, the specific arrangement of steps shown in FIGS. 9 and 10 should not be construed as limiting the scope.

Referring now to FIGS. 1 and 9, one example method begins at the START step and continues to step 902. In step 902, an exposed end 160 of a pin 155 is inserted into a conductor receiver 110. Specifically, the pin 155 is inserted into a cavity 125 of the conductor receiver 110. The pin 155 can be part of a conductor 150. The pin 155 may be inserted into the conductor receiver 110 by a user.

In step 904, an inward force is applied on at least one portion of a wall 120 of the conductor receiver 110. In certain example embodiments, the inward force is applied as the exposed end 160 of the pin 155 is being inserted into the conductor receiver 110. The inward force can be applied using at least one compression member 165 disposed along a portion of an outer perimeter 162 of the pin 155 at a first distance from the exposed end 160. The at least one compression member 165 can extend away from the outer perimeter 162 and toward the exposed end 160 at an acute angle.

In step 906, the at least one portion of the wall 120 contacts the outer perimeter 162 of the pin 155. In certain example embodiments, the wall 120 contacts the outer perimeter 162 of the pin 155 using the inward force. Optionally, the pin 155 can be secured within the conductor receiver 110 once the pin 155 is slidably coupled by at least a minimal distance inside the conductor receiver 110. The pin 155 can be secured by one or more protrusions 130. In addition, or in the alternative, the pin 155 can be secured by one or more other features in the wall 120 and/or in the pin 155. Securing the pin 155 can be preventing the pin 155 from sliding further into the conductor receiver 110. After step 906, the method ends at the END step.

Referring now to FIGS. 2A-3 and 10, another example method begins at the START step and continues to step 1002. In step 1002, a distal portion 291 of a guide pin 265 is inserted into a ring portion 202 of a conductor receiver 210. The guide pin 265 can be mechanically coupled to a conductive pin 255. The guide pin 265 can be electrically non-conductive. Further, the conductive pin 255 and the ring portion 202 of the conductor receiver 210 can be electrically conductive. In certain example embodiments, the conductive pin 255 has a larger perimeter than the front portion 292 of the guide pin 265 and the ring portion 202 of the conductor receiver 210. Further, the ring portion 202 of the conductor receiver 210 can be expandable.

In step 1004, a lateral force is applied to the guide pin 265. In other words, the guide pin 265 is forced further into the conductor receiver 210. The lateral force can be applied directly or indirectly to the guide pin 265. In certain example embodiments, the lateral force slides the guide pin 265 further into the ring portion 202 of the conductor receiver 210. In step 406, a cross-sectional area of the ring portion 202 of the conductor receiver 210 is expanded. In certain example embodiments, the cross-sectional area of the ring portion 202 of the conductor receiver 210 is expanded using a proximal end 290 of the guide pin 265. Specifically, the cross-sectional area (perimeter) of the ring portion 202 is increased.

In step 1008, the lateral force is applied to the guide pin 265. The lateral force applied in this step 1008 can be more, less, or the same as the lateral force applied to the guide pin 265 in step 1004. The lateral force slides the guide pin 265 beyond the ring portion 202 of the conductor receiver 210 into a base portion 201 of the conductor receiver 210. In such a case, the guide pin 265 can be slid into a gap portion 203, positioned between the ring portion 202 and the second portion 201, if a gap portion 203 exists. The lateral force also slides the conductive pin 255 into the base portion 202 of the conductor receiver 210. When this occurs, the base portion 202 of the conductor receiver 210 compresses upon an outer surface 262 of the conductive pin 255. After step 1008, the method ends at the END step. In certain example embodiments, as when the conductor receiver 310 has multiple ring portions and/or gap portions, the process reverts to step 1004 one or more times before proceeding to the END step.

In certain example embodiments, the gap portions (e.g., gap portion 203) is minimal, only enough to allow for independent movement of the ring portions (e.g., ring portion 202). In such a case, particularly with multiple gap portions and ring portions, the only one or a limited number of gap portions would be wide enough to accommodate the protruding feature 293 of the guide pin 265. For example, the most proximate gap portion (e.g., gap portion 302 in FIG. 3) can be wide enough to accommodate the protruding feature 293 of the guide pin 265, while the other gap portions (e.g., gap portions 304 and 306 of FIG. 3) would only be slits, wide enough to allow the adjacent ring portions (e.g., ring portions 303, 305, and 307) to move independently of each other.

Example embodiments provide for reduced temperature rise of electrical connectors. Specifically, example embodiments provide for reducing the rise in temperature of inner portions of an electrical connector by improving electrical contact (increasing the surface area of contact) between a conductor and a conductor receiver within the electrical connector. By improving the electrical contact between a conductor and a conductor receiver, the temperature rise at the connection point(s) is lowered. In other words, because the contact between the conductor and conductor receiver is improved, the loss of energy (which results in heat) is reduced. As a result, the conductor and conductor receiver experience less wear and last longer using example embodiments described herein.

In addition, example embodiments allow for savings in cost and material with respect to electrical connectors. Specifically, engineers designing an electrical system can use a more appropriate size (voltage and/or amperage rating) of connector because, using example reduced temperature rise systems, heat losses are minimized and voltage and/or amperage requirements are more precise. As such, less cost and material is required for a particular electrical connector because smaller electrical connectors require less material.

In addition, the use of example reduced temperature rise systems in an electrical connector can provide one or more of a number of electrical and/or mechanical benefits relative to the electrical connector. Such benefits can include, but are not limited to, strain relief, ease of coupling and decoupling of the electrical connector, ease of maintenance, reduced occurrence of an over-temperature situation, reduced occurrence of an over-current situation, and reduced occurrence of a ground fault situation and/or other short circuit situations. As a result, the amount of wear of the conductor and/or the conductor receiver is reduced using example embodiments.

In addition, in certain example embodiments, such as when the conductor receiver includes meshing or a similar concept (e.g., collapsible walls of a conductor receiver that collapse mechanically as a conductive pin is inserted further into a cavity of the conductor receiver, making full contact with the conductive pin when the conductive pin is fully inserted into the cavity), a low insertion force is required when mechanically coupling the conductor to the conductor receiver. In such cases, particularly with heavier conductors, there is less wear and tear on the components of the conductor and conductor receiver, both in terms of time and in terms of the number of connections/disconnections. As a result, the connectors using example embodiments last longer, requiring less maintenance and lowering costs for repair and replacement.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An electrical connector, comprising:

a conductor receiver comprising an electrically conductive material, a receiving end, and at least one wall enclosing a cavity and forming a receiver shape, wherein the conductor receiver has an inner perimeter, and wherein the conductor receiver further comprises at least one protrusion that extends from the at least one wall into the cavity; and a conductor mechanically coupled to the conductor receiver through the receiving end, wherein the conductor comprises:

a pin comprising the electrically conductive material and an exposed end, wherein the pin has an outer perimeter; and at least one compression member disposed along a portion of the outer perimeter of the pin at a first distance from the exposed end, wherein the at least one compression member extends away from the outer perimeter and toward the exposed end at an acute angle, wherein the at least one protrusion of the conductor receiver is positioned a second distance from the receiving end of the conductor receiver, and wherein the at least one protrusion prevents the pin from extending beyond the at least one protrusion into the cavity formed by the at least one wall.

2. The electrical connector of claim 1, wherein the second distance between the at least one protrusion and the receiving end of the conductor receiver is at least as great as the first distance.

3. The electrical connector of claim 1, wherein the at least one protrusion has a length that is at most equal to a perimeter of the cavity.

4. The electrical connector of claim 1, wherein the at least one protrusion comprises an electrically conductive material, wherein the at least one protrusion transfers electricity with the exposed end of the pin.

5. The electrical connector of claim 1, wherein the at least one compression member comprises an electrically non-conductive material.

6. The electrical connector of claim 1, wherein the at least one compression member causes, when the conductor receiver is mechanically coupled to the conductor, the at least one wall to make further contact with the pin.

7. The electrical connector of claim 1, wherein the pin has a pin shape that fits within the receiver shape as the conductor is movably coupled to the conductor receiver.

8. The electrical connector of claim 7, wherein the pin shape is substantially the same as the receiver shape, and wherein the inner perimeter of the conductor receiver is slightly greater than the outer perimeter of the pin.

9. An electrical connector, comprising:

a conductor receiver comprising:

a first ring portion comprising:

an electrically conductive material;

at least one first wall enclosing a first cavity, forming a first receiver shape, and having a first inner perimeter; and at least one slot that extends along a length of the first portion; and a base portion comprising at least one second wall enclosing a second cavity, forming a second shape, and having a second inner perimeter;

a conductor mechanically coupled to the conductor receiver through the first cavity of the first portion and the second cavity of the second portion, wherein the conductor comprises:

a conductive pin comprising the electrically conductive material and a distal mating end, wherein the conductive pin mechanically couples to the first portion of the conductor receiver; and a guide pin mechanically coupled to the conductive pin and the second portion of the conductor receiver, wherein the guide pin comprises an electrically non-conductive material.

10. The electrical connector of claim 9, wherein the conductor receiver further comprises a first gap portion positioned between the first ring portion and the base portion, wherein the first gap portion comprises a channel having a width and traversing at least part of the first gap portion.

11. The electrical connector of claim 10, wherein the guide pin further comprises a protruding feature proximate to where the first ring portion mechanically couples to the base portion, wherein the protruding feature expands the first inner perimeter of the first base portion when the conductor moves within the conductor receiver, and wherein the channel of the gap portion acts as a stop feature with respect to the protruding feature when the conductor is mechanically coupled to the conductor receiver.

12. The electrical connector of claim 9, wherein the first base portion has a diameter greater than that of the base portion.

13. The electrical connector of claim 9, wherein the base portion is made of the electrically non-conductive material.

14. The electrical connector of claim 9, wherein the conductive pin has a first outer perimeter that is slightly greater than the first inner perimeter of the first base portion of the conductor receiver.

15. The electrical connector of claim 9, wherein guide pin has a second outer perimeter that is slightly less than the second inner perimeter of the base portion of the conductor receiver.

16. The electrical connector of claim 9, wherein the conductive pin has a conductive pin shape that fits within the first shape as the conductor is movably coupled to the conductor receiver.

17. The electrical connector of claim 9, wherein the guide pin has a guide pin shape that fits within the first shape and the second shape as the conductor is mechanically coupled to the conductor receiver.

18. A method for increasing a contact surface within an electrical connector, the method comprising:

inserting an exposed end of a pin into a cavity of a conductor receiver, wherein the pin is inserted axially along a length of the pin into the cavity;

applying, as the exposed end of the pin is being inserted into the conductor receiver, an inward force on at least one portion of a wall of the conductor receiver, wherein the inward force is applied using at least one compression member disposed along a portion of an outer perimeter of the pin at a first distance from the exposed end, wherein the at least one compression member extends away from the outer perimeter and toward the exposed end at an acute angle;

contacting, using the inward force, the at least one portion of the wall against the outer perimeter of the pin; and contacting, using the inward force, the exposed end of the pin against at least one protrusion within the cavity, wherein the at least one protrusion prevents the pin from extending beyond the at least one protrusion into the cavity formed by the at least one wall.

19. A method for increasing a contact surface within an electrical connector, the method comprising:

inserting a distal portion of a guide pin into a ring portion of a conductor receiver, wherein the guide pin is mechanically coupled to a conductive pin, wherein the guide pin is electrically non-conductive, wherein the conductive pin and the ring portion of the conductor receiver are electrically conductive, wherein the conductive pin has a larger perimeter than the front portion of the guide pin and the ring portion of the conductor receiver, and wherein the ring portion of the conductor receiver is expandable;

applying a lateral force to the guide pin, wherein the lateral force moves the guide pin further into the ring portion of the conductor receiver;

expanding, using a proximal end of the guide pin, a cross-sectional area of the ring portion of the conductor receiver; and applying the lateral force to the guide pin, wherein the lateral force moves the guide pin beyond the ring portion of the conductor receiver into a base portion of the conductor receiver, and wherein the lateral force moves the conductive pin into the ring portion of the conductor receiver, wherein the ring portion of the conductor receiver compresses upon an outer surface of the conductive pin.

20. An electrical connector, comprising:

a conductor receiver comprising a plurality of contact segments arranged circumferentially around, and mechanically coupled to, a first end piece at a proximal end and a second end piece at a distal end, wherein the plurality of contact segments form a cavity, wherein each of the contact segments is made of a semi-flexible and resilient electrically conductive material and has a profile, and wherein each of the contact segments comprises a middle portion that is directed inward relative to the proximal end and the distal end; and a conductor mechanically coupled to the conductor receiver through the cavity, wherein the conductor comprises:

a distal end having a first perimeter;

a proximal end comprising the electrically conductive material and having a second perimeter and a shape, wherein the second perimeter is greater than the first perimeter; and a ramp disposed between the distal end and the proximal end, wherein the shape corresponds to the profile of the plurality of contact segments, and wherein the middle portion of each of the plurality of contact segments contacts the proximal end of the conductor when the conductor is inserted into the conductor receiver.

21. An electrical connector, comprising:

a conductor receiver comprising:

a body comprising a cavity that runs longitudinally therethrough and, at a proximal end, at least one compression member that extends away from the cavity at an acute angle and forms a space;

an element movably disposed within the cavity that traverses the length of the body and having a proximal end that extends into the space created by the at least one compression member, wherein the element comprises an electrically conductive material; and a webbed clip fixedly coupled to the proximal end of the electrically conductive element, the webbed clip comprising:

a base mechanically coupled to the proximal end of the electrically conductive element and comprising the electrically conductive material;

at least one clip arm mechanically coupled to the base, and comprising at least one hinged feature and the electrically conductive material;

at least one clip finger mechanically coupled to a distal end of the at least one clip arm and comprising the electrically conductive material; and a compressive element disposed around the electrically conductive element in the space between the base and the body; and a conductor mechanically coupled to the webbed clip, wherein the conductor comprises:

an extension disposed at a distal end of the conductor and having a size sufficient to contact the base and avoid contacting the at least one clip arm; and a pin mechanically coupled to the extension and comprising the electrically conductive material, wherein the at least one clip finger contacts the pin when the conductor is inserted into the conductor receiver.

22. An electrical connector, comprising:

a conductor receiver system comprising:

a frame;

a conductor receiver coupled to the frame and comprising:

a proximal collar fixedly coupled to the frame and having a shape;

a distal collar comprising an electrically conductive material and having substantially the shape; and a meshing mechanically coupled to the proximal collar and the distal collar, wherein the meshing comprises the electrically conductive material and has a first perimeter in an unstretched state and a second perimeter in a stretched state; and a displacement device fixedly coupled to the distal collar and movably coupled to the frame, wherein the displacement device moves in a lateral direction relative to the proximal collar; and a conductor mechanically coupled to the conductor receiver through the proximal collar, wherein the conductor comprises a pin comprising the electrically conductive material and has a third perimeter, wherein the third perimeter of the pin is less than the first perimeter of the meshing, and wherein the third perimeter of the pin is greater than the second perimeter of the meshing.

23. The electrical connector of claim 22, wherein the pin is inserted into the meshing using a low amount of force.

24. The electrical connector of claim 22, wherein insertion and removal of the conductor from the conductor receiver causes a low amount of wear on the conductor and the conductor receiver.

25. The electrical connector of claim 22, wherein the meshing in the stretched state creates a number of contact points with the pin, wherein the number of contact points increase a surface area of contact between the pin and the meshing.

* * * * *